US005462808A

United States Patent [19]

Asabe et al.

[11] Patent Number: 5,462,808

[45] Date of Patent: Oct. 31, 1995

[54] HIGHLY RIGID COMPOSITE MATERIAL AND PROCESS FOR ITS MANUFACTURE

[75] Inventors: Kazutaka Asabe, Sanda; Masaru Nishiguchi, Ashiya; Sukeyoshi Yamamoto, Amagasaki, all of Japan

[73] Assignee: Sumitomo Metal Industries, Ltd., Osaka, Japan

[21] Appl. No.: 300,034

[22] Filed: Sep. 2, 1994

[30] Foreign Application Priority Data

| | | | |
|---|---|---|---|
| Sep. 3, 1993 | [JP] | Japan | 5-220121 |
| Sep. 3, 1993 | [JP] | Japan | 5-220122 |
| Sep. 3, 1993 | [JP] | Japan | 5-220123 |
| Sep. 3, 1993 | [JP] | Japan | 5-220124 |
| Sep. 13, 1993 | [JP] | Japan | 5-227325 |
| Sep. 13, 1993 | [JP] | Japan | 5-227326 |
| Sep. 13, 1993 | [JP] | Japan | 5-227328 |

[51] Int. Cl.$^6$ ..... B22F 3/00; C22C 29/00

[52] U.S. Cl. ..... 428/551; 428/548; 428/552; 75/230; 75/232; 75/235; 75/244; 75/246

[58] Field of Search ..... 428/548, 551, 428/552; 75/230, 232, 235, 244, 246; 419/26, 28, 29, 31, 33, 49

[56] References Cited

U.S. PATENT DOCUMENTS

| | | | |
|---|---|---|---|
| 3,650,729 | 3/1972 | Kindlimann et al. . | |
| 4,139,377 | 2/1979 | Bergh et al. | 75/243 |
| 4,268,309 | 5/1981 | Seriho et al. | 75/230 |
| 4,615,734 | 10/1986 | Spriggs | 75/237 |
| 4,963,317 | 10/1990 | Wiencek et al. | 376/422 |
| 5,395,464 | 3/1995 | Davidson | 148/675 |

FOREIGN PATENT DOCUMENTS

| | | |
|---|---|---|
| 56-23223 | 3/1981 | Japan . |
| 59-83721 | 5/1984 | Japan . |
| 4-143216 | 5/1992 | Japan . |
| 4-293719 | 10/1992 | Japan . |
| 4-293720 | 10/1992 | Japan . |

*Primary Examiner*—Donald P. Walsh
*Assistant Examiner*—John N. Greaves
*Attorney, Agent, or Firm*—Burns, Doane, Swecker & Mathis

[57] ABSTRACT

A high-rigidity composite material having a Young's modulus larger than 25,000 kgf/mm$^2$ is disclosed, in which particles are dispersed in a matrix of a ferritic steel, and the degree of accumulation of {111} planes in a plane perpendicular to a given direction, in terms of X-ray diffraction intensity, is 30 times larger than that of equiaxial polycrystals.

14 Claims, No Drawings

HIGHLY RIGID COMPOSITE MATERIAL AND PROCESS FOR ITS MANUFACTURE

BACKGROUND OF THE INVENTION

The present invention relates to a highly-rigid composite material and a process for its manufacture. More particularly, the present invention relates to a composite material having a high Young's modulus and a process for its manufacture. The rigid composite material of the present invention may be employed for use in manufacturing automotive Vehicles and industrial robots, for example.

Recently, there has been a strong demand in the automotive industry for new materials which are light-weight for achieving low fuel consumption and have high damping characteristics for achieving a high level of comfort during driving.

Namely, when a highly rigid material is used for lightening an automotive part, such a part Can be small-sized, since its high rigidity enables it to absorb strains, i.e., it can resist bending or other forces. Furthermore, when a highly rigid material is used as a damping material, a small volume of the material can be used to absorb vibrations or strains.

A material having a high Young's modulus therefore has a remarkable potential for wide application in automotive parts and in many other structural members.

In order to increase rigidity, i.e., the Young's modulus of a material, it has been conventional to incorporate an alloying element or particles having a high Young's modulus in the material. However, when a solid-solution element (Re-element) is added to an Fe-based alloy, the Young's modulus is increased to about 21,000 to 22,000 kgf/mm$^2$ at highest. When Nb(C,N) particles are added to an Fe-based alloy, the Young's modulus is about 24,000 to 25,000 kgf/mm$^2$ at highest, and ductility and toughness are not satisfactory.

On the other hand, in the case of steel, it is conventional to apply thermomechanical treatment to the steel to orient or dispose crystals in a direction at which they exhibit a higher Young's modulus so that a high degree of rigidity can be obtained. According to this material design process, {111} planes are oriented in a given direction in the case of ferritic steel which has a body-centered cubic lattice. However, in the past as shown in Japanese Laid-Open Patent Application No. 23223/1981 and No.83721/1984, even if orientation of crystals in a given direction is performed by applying working with a working ratio higher than 5–10% and then heat treatment such as tempering or coiling at a temperature lower than 720°–900° C., the resulting Young's modulus is 23,000–24,000 kgf/mm$^2$ at highest.

SUMMARY OF THE INVENTION

A general object of the present invention is to provide a high-rigidity material and a process for manufacturing the material which exhibits improvement in ductility and toughness and has a high concentration of strains introduced by working.

A more specific object of the present invention is to provide a high-rigidity material having a Young's modulus larger than 25,000 kgf/mm$^2$ and a process for its manufacture.

It was found by the inventors of the present invention that a main reason why a thermomechanical treatment does not give a satisfactory improvement in Young's modulus is that an accumulation ratio of {111} planes is just 15–20 times larger than that of equiaxial polycrystals. This is because the amount of strains which are introduced during working and the degree of their concentration are small.

The inventors also made the following discoveries.

1) It is advisable to retain work-induced strains by incorporating and dispersing particles in a matrix in order to fix dislocations. For a material having particles dispersed in the matrix, hot working with an extrusion ratio of 3 or more will be effective to provide a sufficient amount of strains.

2) For a material in which dislocations introduced by the above-described hot working have been fixed with the dispersed particles, the following heat treatment carried out at a high temperature, e.g., 1300° C. will cause a rapid secondary recrystallization and will also result in a high degree of orientation of {111} planes in the working direction.

3) When rolling with a high reduction ratio is applied to an alloy powder in which particles are finely dispersed, the introduced dislocations are fixed by the dispersed particles, resulting in a large amount of lattice distortions being introduced and retained. A sufficient amount of strains can be introduced to a material containing the dispersed particles by the application of rolling with a rolling ratio of 2 or more. The subsequent heat treatment at a high temperature e.g., 1300° C. will be able to carry out a rapid secondary recrystallization and will also be able to achieve a high degree of orientation of {111} planes in the direction perpendicular to the rolling direction, i.e., rolling-width direction, resulting in a high Young's modulus in this direction. The presence of the dispersed particles in the matrix will increase strength of the rolled material due to the strengthening effect caused by fine dispersion of particles.

According to one aspect, the present invention is a high-ridgidity composite material having particles dispersed in a matrix of a ferritic steel structure, with the degree of alignment of {111} planes in a plane perpendicular to a given direction, in terms of X-ray diffraction intensity, being 30 times larger than that of equiaxial polycrystals.

According to another aspect, the present invention is a high-rigidity composite material having particles dispersed in a matrix of a ferritic steel structure, with the ratio of {222} planes to {110} planes in a plane perpendicular to a given direction, in terms of X-ray diffraction intensity, being 0.10 or larger.

According to still another aspect, the present invention is a wear resistant, high-rigidity composite material having particles dispersed in a matrix of a ferritic steel structure, the {111} planes being oriented in a plane perpendicular to a given direction, with a surface hardening layer derived from carburization, nitriding, or soft-nitriding being placed in the surface thereof.

In a preferred embodiment, the ferritic steel has an alloy composition comprising 30% by weight or less of Cr, 0–8% by weight of Al, and 0–4% by weight of Si.

In another preferred embodiment, the ferritic steel has an alloy composition comprising 4% by weight or less of Si.

One of the typical methods of achieving accumulation of {111} planes in a given direction to the degree mentioned above is to extrude a composite powder having dispersed particles with an extrusion ratio of 3 or more and to carry out a secondary recrystallizing heat treatment.

Another method of achieving accumulation of {111} planes as described above is to effect rolling with a rolling ratio of 2 or more followed by the secondary recrystallizing heat treatment.

Preferably, the composite powder is manufactured by a mechanical alloying method.

In this context, "in a given direction" means "in any one predetermined direction", and usually this direction is the extrusion direction or rolling-width direction.

The present invention is also a process for manufacturing a composite material having a high Young's modulus in which the degree of accumulation of {111} planes in a given direction, in terms of X-ray diffraction intensity, is 30 times larger than that of equiaxial polycrystals, comprising the steps of preparing a composite powder having an alloy composition of a ferritic steel as a whole, and particles being dispersed in the matrix, forming the composite powder into a shape by means of extrusion with an extrusion ratio of 3 or more, and carrying out a heat treatment to effect a secondary recrystallization.

Furthermore, the present invention is a process for manufacturing a composite material having a high Young's modulus in which the ratio of the {222} planes to the {110} planes in a given direction in terms of X-ray diffraction intensity is 0.10 or more, comprising the steps of preparing a composite powder having an alloy composition of a ferritic steel as a whole with particles dispersed in the matrix, forming the composite powder into a shape by means of extrusion with an extrusion ratio of 3 or more, and carrying out a heat treatment to effect secondary recrystallization.

In another aspect, the present invention is a process for manufacturing a composite material having a high Young's modulus in which the degree of accumulation of {111} planes in a given direction, in terms of X-ray diffraction intensity, is 10 times larger, preferably 30 times larger than that of equiaxial polycrystals, comprising the steps of preparing a composite powder having an alloy composition of a ferritic steel as a whole with particles dispersed in the matrix, forming the composite powder into a shape by means of rolling with a rolling ratio of 2 or more, and carrying out a heat treatment to effect a secondary recrystallization.

Furthermore, the present invention is a process for manufacturing a composite material having a high Young's modulus in which the ratio of the {222} planes to the {110} planes in a given direction in terms of X-ray diffraction intensity is 0.10 or more, comprising the steps of preparing a composite powder having an alloy composition of a ferritic steel as a whole with particles dispersed in the matrix, forming the composite powder into a shape by means of rolling with a rolling ratio of 2 or more, and carrying out a heat treatment to effect secondary recrystallization.

DESCRIPTION OF THE PREFERRED EMBODIMENTS

According to the present invention the matrix phase of the composite material comprises a ferritic steel structure having a body-centered cubic lattice with particles being dispersed throughout the matrix. This is because the Young's modulus is about 29,000 kgf/mm$^2$ in the direction of <111> for the ferritic steel.

The ferritic steel employed in the present invention is not restricted to a specific one so long as it comprises a ferritic phase. It may be an Fe—Cr system, Fe—Al system, or Fe—Si system ferritic steel. In a preferred embodiment, the steel may comprise, as a ferrite-former, at least one of Cr, Al, and Si.

Thus, in its broad sense, the ferritic steel comprises 0–30% by weight of Cr, 0–8% by weight of Al, and 0–4% by weight of Si.

Within this range of ferritic steel compositions there are many preferred varieties described below.

I) The ferritic steel matrix comprises 16% by weight or less of Cr, and 0–3.0% by weight of Al.

The presence of Cr of not more than 16% is to avoid a degradation in toughness caused by precipitation of carbide or intermetallic compounds of Cr during heat treatment. When surface hardening is to be applied to the surface of a final product, such as crankshafts or piston pins, so as to improve wear resistance, it is necessary to carry out carburizing and quenching. However, in the presence of Cr in a large amount, a ferritic phase is stabilized too much to effect transformation into martensite by quenching after carburizing.

Al is optionally added so as to improve oxidation resistance. The addition of Al in an amount of not more than 3.0% by weight is effective not only to avoid a degradation in toughness but also to prevent a reaction between Al and dispersing particles such as $Y_2O_3$ and $Al_2O_3$. Such a reaction causes coarsening of the dispersing particles, resulting in an insufficient accumulation of the {111} planes during the secondary recrystallization, and especially in the case of $Al_2O_3$, it is difficult to achieve a high Young's modulus. A decrease in strength is also inevitable.

II) The ferritic steel matrix comprises 0–16% by weight of Cr, and more than 3% by weight but not more than 8% by weight of Al.

Al is added in an amount of more than 3% by weight as a ferrite former and as an element to improve oxidation resistance and strength. The addition of Al in an amount of not more than 8.0% by weight is effective not only to avoid a degradation in toughness but also to prevent a reaction between Al and dispersing particles such as $Y_2O_3$ and $Al_2O_3$. Such a reaction causes coarsening of the dispersing particles, resulting in insufficient accumulation of the {111} planes during the secondary recrystallization, and especially in the case of $Al_2O_3$ it is difficult to achieve a high Young's modulus. A decrease in strength is also inevitable.

In addition, when surface hardening is to be applied to the surface of a final product, such as crankshafts or piston pins, so as to improve wear resistance, it is necessary to carry out carburizing and quenching, but in the presence of Al in an amount larger than 8% by weight a ferritic phase is stabilized too much to effect transformation into martensite by quenching after carburizing.

III) The ferritic steel matrix comprises more than 16% by weight but not more than 30% by weight of Cr, and 0–4% by weight of Al.

The addition of Cr in an amount of more than 16% by weight is effective to improve not only corrosion resistance in an acid such as nitric acid but also weather resistance when the steel is used near the ocean. When the Cr content is over 30% by weight, a marked degradation in toughness and strength is inevitable.

Al is optionally added so as to improve oxidation resistance. It is advisable to restrict the Al content to 4% or less so as to avoid a degradation in toughness. When the dispersing particles are $Al_2O_3$ particles, coarsening of the $Al_2O_3$ particles is inevitable, resulting in a low Young's modulus.

When the Cr content is over 16%, it is advisable to restrict the Al content to not more than 4% by weight, since the 475° C. embrittlement (temper brittleness) is experienced for a high Cr-high Al steel when it is heated around 475° C. Thus, when the composition material is used for manufacturing automobile engines, especially exhaust valves, which are exposed to a high temperature, the Al content is restricted to not more than 4% for a ferritic steel which contains Cr in an amount of over 16%.

IV) The ferritic steel matrix comprises 4% by weight or less of Si.

In the case of the Fe—Si binary system, Si is added as a ferrite former in an amount of 4% by weight or less, since it is necessary to maintain a single ferrite phase even at a high temperature of around 1300° C. The presence of Si is also effective for improving oxidation resistance as well as heat resistance. When the composite material of the present invention is employed to manufacture exhaust valves or intake valves of automobiles, the material is required to exhibit heat resistance as well as oxidation resistance. For this purpose the addition of Si is necessary.

The presence of not more than 4% by weight of Si is effective to avoid a degradation in toughness and strength.

In addition, when surface hardening is to be applied to the surface of a final product, such as crankshafts and piston pins, so as to improve wear resistance, it is necessary to carry out carburizing and quenching, but in the presence of Si in an amount lager than 4% by weight a ferritic phase is stabilized too much to effect transformation into martensite by quenching after carburizing.

According to the present invention, high rigidity can be achieved by utilizing properties inherent to a ferritic steel phase, and the present invention is not restricted to a specific steel composition so long as the steel has a ferritic phase.

From a practical viewpoint, however, it is desirable to further incorporate one or more of the following elements in the above-described ferritic steels.

C: 0.2% or less,

Mn: 1.0% or less,

Ni: 3.0% or less,

Mo: 2.5% or less,

W: 5.0% or less,

Nb: 3.0% or less,

Ti: 2.0% or less,

V: 2.0% or less,

Si: 0.5% or less,

P: up to 0.1%,

S: up to 0.1%,

Oxygen: up to 0.2% except for oxygen combined as oxides,

Nitrogen: up to 0.2% except for nitrogen combined as nitrides.

These elements are optional. However, it is desirable to add at least one of Ni, Mo, W, Nb, Ti, and V in order to further improve strength and toughness.

Namely, the addition of a small amount of C or Mn is effective to improve strength, and the addition of Ni is effective to improve toughness. When these elements are added in an amount over the above-described upper limits, they do not give a high Young's modulus even if the secondary recrystallization heat treatment is applied after working, depending on the Cr content of the matrix. This is because transformation of an α-phase into a γ-phase occurs and because a sufficient amount of ferrite <111> texture structure is not formed.

The addition of Mo and W in amounts of not more than 2.5% and 5.0%, respectively, results in an increase in strength because of solid-solution strengthening. When they are added in amounts larger than those given above, intermetallic compounds such as a sigma phase are precipitated along crystal grain boundaries, resulting in embrittlement.

When Nb, Ti and V are each added in a small amount, they form carbides to fix carbon, resulting in stabilization of a ferritic phase as well as strengthening of the ferritic phase due to precipitation strengthening. However, when they are added in amounts over 3.0%, 2.0%, and 2.0%, respectively, the occurrence of embrittlement caused by precipitation of carbides along grain boundaries is inevitable.

Si, P, and S are present as impurities, usually up to 0.5%, 0.1%, and 0.1%, respectively. When they are present in excessive amounts, precipitation thereof is inevitable, resulting in a degradation in toughness.

When oxygen and nitrogen are present each in an amount of 0.2% or less, an improvement in strength is observed, but if they are added in excess of these amounts, toughness is degraded.

Thus, according to the present invention, in order to increase the Young's modulus, it is important to employ a ferritic steel and to highly accumulate {111} planes thereof in a plane perpendicular to a given direction. The more the retained amount of strains introduced by working, i.e., the retained amount of dislocations, the more easily the {111} planes of a ferritic steel are accumulated. According to the present invention, therefore, the strains, i.e., dislocations, which are introduced during working, are fixed with dispersing particles so as to increase the retained amount thereof.

The dispersing particles may be those particles selected from oxides, carbides, nitrides, borides, or the like. An average particle diameter is preferably 0.005–0.1 um, and they are preferably added in an amount of 0.2–5% by volume.

Types, shapes, sizes, and amounts of the dispersing particles are not limited to specific ones, but in a preferred embodiment of the present invention, they must be stable upon heating, and have a size large enough to sufficiently fix dislocations. Furthermore, in order to ensure a practical level of ductility and toughness for an engineering material, it is preferable to restrict the amount of the dispersing particles to a low level.

In a preferred embodiment, dispersing particles are those which do not dissolve into a ferritic steel matrix at a temperature higher than 1200° C., which have an average diameter of 0.1 μm or less, and which are boride particles or particles of an oxide of the easily oxidized elements, such as Al, Ti, and Y added in an amount of 3% by volume or less. The particles may be nitride particles of the easily nitrided elements, such as Al and Ti added in an amount of 3% by volume or less.

In a process for manufacturing the above-described composite material having a high Young's modulus, a starting powder may have a ferritic steel composition as a whole. Namely, the starting powder may be a mixture of powders of respective elements which constitute a ferritic steel composition as a whole, or a single or mixed powder of one or more ferritic steel compositions.

Methods of finely distributing or forming the dispersed particles in a ferritic steel matrix include chemical reaction during mechanical alloying, direct incorporation of the dispersing particles during mechanical alloying (mechanical alloying with addition of dispersing particles), rapid dispersion during rapid solidification in a gas atomization process, and reaction heat treatment, such as internal oxidation.

The "mechanical alloying (MA)" herein means a process for intensively mixing powders under cold conditions using a ball mill, within which each particle is subjected to repeated rolling, forging, and welding.

The following are some examples in which the dispersing particles are formed via oxidation reactions occurring during mechanical alloying or heat treatment following the mechanical alloying during which oxygen or nitrogen has been dissolved in excess in solid solution.

When a powder having an Fe—Cr ferritic steel composition containing at least one easily oxidized element or Cr in metallic or elemental state, i.e., in a non-oxidized form is used, it may be possible to prepare the oxides by carrying out mechanical alloying under the following conditions so that particles of oxide of Cr or easily oxidized element are finely dispersed:

(i) an oxygen-containing powder is used as a starting powder, or (ii) an oxygen-containing atmosphere is used.

Instead of oxidation, nitriding and/or carburizing may be performed during mechanical alloying. Namely, when nitriding is intended, an easily-nitrided element or Cr and/or a nitrogen-containing gas atmosphere are employed. Similarly, when carburizing is intended, an easily-carburized element or Cr and/or a carbon-containing atmosphere are employed.

In this description, a powder of Fe—Cr ferritic steel composition means (1) a powder of Fe—Cr ferritic steel itself, (2) a mixture of powders of respective elements, the mixture being an Fe—Cr ferritic steel composition as a whole, (3) a mixture of many powders which contains powder of an alloy but has an Fe—Cr ferritic steel composition as a whole, and (4) a mixture of alloy powders of at least two alloys.

In addition, the Fe—Cr system ferritic steel composition means not only 100% ferritic steel, but also a stainless steel which contains about 5% of an austenitic phase. The presence of at least 95% of a ferritic phase is enough to obtain a high Young's modulus.

The easily oxidized elements may be the ones originating from the steel alloy, or it may also be added intentionally to a starting powder.

An atmosphere in which mechanical alloying is carried out may contain 0.001–5 vol % of oxygen, and the state of dispersion can be controlled by adjusting the time of treatment. A preferred atmosphere is one containing argon gas and oxygen gas.

It is desirable that the oxygen content of a metallic powder or alloy powder be restricted to 0.01–2.0 wt %. In addition to dissolved oxygen, iron oxides, and chromium oxides which are inevitably contained in a starting powder, additional amounts of iron oxides and chromium oxides, e.g., in an amount of 0.05–2.0% by weight, can be optionally added to the starting powder in order to precisely control the amount of oxygen.

When oxygen in solid-solution is used to precipitate oxides, it is advantageous to heat the powder usually at a temperature of 800°–1200° C. This temperature range corresponds to that at which subsequent heavy-duty working is carried out, and it is possible to precipitate oxides during working without providing an independent heating step.

The before-described easily oxidized element reacts with oxygen contained in an atmosphere, or it reacts with oxygen contained in an alloying element in the course of mechanical alloying. In case oxygen in solid solution is used, the easily oxidized element reacts with this oxygen to precipitate fine oxides in the course of subsequent steps of heating and working. Thus, fine oxide particles having a diameter of 5–50 nm are dispersed uniformly in a ferritic steel matrix.

As an example, the case will be described in which a starting powder does not have $Al_2O_3$ but has Al as an alloying element. $Al_2O_3$ particles which are formed during mechanical alloying have an average particle diameter of 10 nm. This is very fine compared with $Al_2O_3$ particles which are incorporated in a starting powder and which have an average particle diameter of 60 nm.

As is apparent from the foregoing, a main purpose of mechanical alloying is to carry out alloying of alloying elements contained in a starting powder. In addition, according to the present invention, an important role of the mechanical alloying is to react alloying elements contained in the starting powder with oxygen of the atmosphere or oxygen contained in the alloying elements such as Fe and Cr so as to form oxide particles. In addition, mechanical alloying is effective to dissolve oxygen in excess as oxygen in solid solution, and the dissolved oxygen is precipitated as fine oxides during subsequent steps of heating and working.

In another embodiment of the present invention in which a starting powder has an Fe—Cr ferritic steel composition but does not contain the above-described easily oxidized element is used, it is the Cr oxides that are finely dispersed throughout the ferritic steel matrix.

Furthermore, according to the present invention, instead of performing the before-described mechanical alloying, reactive heat treatment may be employed so as to make a fine dispersion of dispersing particles. These dispersing particles are derived from an oxidizing, nitriding, or carburizing reaction which takes place prior to working.

Thus, in a still another embodiment of the present invention, a starting powder having an Fe—Cr ferritic steel composition is subjected to working such as extrusion with an extrusion ratio of 3 or more, the resulting extrudate is further subjected to secondary recrystallization, and prior to working, the starting powder is subjected to a reactive heat treatment so as to disperse fine particles in any of the following ways (i) to (iii).

(i) The starting powder contains at least one easily oxidized element or Cr, and is heat treated in an oxidizing atmosphere.

(ii) The starting powder contains at least one easily nitrided element or Cr, and is heat treated in a nitriding atmosphere.

(iii) The starting powder contains at least one easily carburized element or Cr, and is heat treated in a carburizing atmosphere.

The easily oxidized, or nitrided, or -carburized element means an element which more easily forms an oxide, nitride, or carbide, respectively, compared than do Fe and Cr.

The easily oxidized element or easy-oxidizing element includes, for example, Al, Ti, Mn, Y, Zr, Nb, Mg, Be, Hf, V, Th, and rare earths.

The easily nitrided element or easy-nitriding element includes, for example, Zr, Ti, Al, B, Mg, Nb, Si, V, Ta, Y, and rare earths.

The easily carburized element or easy-carburizing element includes, for example, Zr, Ti, Ta, Al, V, Nb, Y, and rare earths.

These easily oxidized, nitrided, or -carburized elements are respectively reacted with oxygen, nitrogen, and carbon of the atmosphere in the course of the reactive heat treatment, to form oxides, nitrides, and carbides, respectively, each having a particle diameter of 5–50 nm and being finely dispersed.

According to this reactive heat treatment, when a starting powder contains Ti and is subjected to the nitriding heat treatment, i.e., heat treatment for nitriding, the resulting nitride (TiN), nitride, has an average particle diameter of about 10 nm, which is finer than that of TiN particles which are introduced by way of mechanical alloying, and which have an average particle size of 60 nm.

Since the purpose of the reactive heat treatment is to form particles of oxide, nitride, and carbide by the reaction with oxygen-, nitrogen-, and carbon-containing gas, respectively, and to disperse the resulting fine particles uniformly, conditions for achieving the reactive heat treatment are not restricted to specific ones so long as these fine particles can be dispersed uniformly throughout the ferritic steel matrix.

According to a preferred embodiment of the present invention, an Fe—Cr ferritic steel composition powder containing the above-described easily oxidized, nitrided, or carburized element, which may be a single powder or a combined powder, is used as a starting powder. Depending on the type of a reactive gas in the atmosphere, particles of an oxide, nitride, or carbide are formed and dispersed.

In another preferred embodiment of the present invention, an Fe—Cr ferritic steel composition powder which does not contain any of the above-described easily oxidized, nitrided, or carburized elements may be used. In this case, depending of the type of the atmosphere, particles of an oxide, nitride, or carbide of Cr are formed and finely dispersed.

For a reactive heat treatment, one or more of Al, Ti, Mn, Y, Zr, Nb, Mg, Be, Hf, V, Th, and rare earths may be used as an easily oxidized element. These elements form respective oxides in the course of the reactive heat treatment, including $Al_2O_3$, $Y_2O_3$, $TiO_2$, $ZrO_2$, NbO, MnO, MgO, and $SiO_2$. They may form complex oxides, such as $Y_xAl_yO$, $Ti_xY_yO$, and $Al_xTi_yO$.

One or more of Zr, Ti, Al, B, Mg, Nb, Si, V, Ta, Y, and rare earths may be used as an easily nitrided element. These elements form respective nitrides in the course of the reactive heat treatment, including nitrides and complex nitrides, such as ZrN, TiN, AlN, BN, $Mg_3N_2$, NbN, $Si_3N_4$, VN, TaN, and YN.

One or more of Zr, Ti, Ta, Al, V, Nb, Y, and rare earths may be used as an easily carburized element. These elements form respective carbides in the course of the reactive heat treatment, including carbides and complex carbides, such as ZrC, TiC, TaC, $Al_4C_3$, VC, NbC, and $Y_2C_3$.

The thus-obtained oxides, nitrides, or carbides may be a mixture thereof, and a mixture or complex with borides and the like.

The amount of these elements to be added is not restricted, but is varied depending on its purpose of addition. Preferably, as a metallic element, the amount is 1.0–5.0%.

Formation of oxides, nitrides and carbides is caused by a reaction between a surrounding gas and the surface of particles. Such a reaction is controlled by the processing time and particle size. Although the particle size of a starting powder is not restricted to a specific one, a preferred one is that which enables a uniform and fine distribution of the particles after a short period of treatment. Thus, a preferred particle size is 1000 μm or less, more preferably 250 μm or less.

A starting powder itself may be prepared by any other processes, including a process for breaking and grinding ingots, an atomization process, and plasma rotating electrode process (PREP). Such a starting powder is used to react with oxygen, nitrogen, or carbon of an atmosphere to form fine particles which are therefore dispersed in the surface or inside of the constituent particles of the powder.

When oxide particles are formed, for example, the oxidizing reaction can be controlled by varying the partial pressure of oxygen ($Po_2$), the ratio of $H_2/H_2O$, or that of $CO/CO_2$. It is quite difficult, however, to control the partial pressure of oxygen. Namely, when the oxidizing reaction is to be carried out at 800°–1100° C. while Fe and Cr are not oxidized but just the easy-oxidizing elements such as Ti and Al are oxidized, it is necessary to adjust the partial pressure of oxygen to be lower than $10^{-20}$ atmospheric pressure, which is rather difficult.

On the other hand, it is relatively easy to control the ratio of $H_2/H_2O$. The control of the ratio of $H_2/H_2O$ can be achieved by controlling the dew point of an $H_2$-containing atmosphere. In order to control Cr as well as the easily oxidized elements such as Ti and Al, but not Fe, it is sufficient to adjust the dew point to be 40° C. or lower. On the other hand, in order to oxidize the easily oxidized elements such as Ti and Al, but not Fe nor Cr, it is necessary to adjust the dew point to be −30° C. to −70° C. This can be achieved by using hydrogen gas under usual conditions.

It is sufficient to control the $CO/CO_2$ ratio, within a range of 1/3 to $10^4/1$, which is easy to achieve.

Although the reaction temperature and time are not restricted, it is desirable to carry out a reactive heat treatment at a temperature of 800°–1100° C. for 15–100 minutes in order to avoid an extreme level of sintering or welding of particles.

In the case of nitriding, the atmosphere may be any one which contains nitrogen gas, such as an atmosphere which contains $N_2$ gas, ammonia gas, or $N_2+H_2$ gases. Control of reaction is rather difficult when the reaction takes place at a high temperature. Thus, it is desirable that the reaction be carried out at a temperature of 500°–800° C. for a rather long period of time, i.e., about 2–10 hours.

In the case of carburizing, a carbon-containing gas is employed. As a gaseous carburizing atmosphere, $CO+CO_2$ gases atmosphere, alcohol-added gaseous atmosphere, methane gas atmosphere, and RX gas atmosphere are preferable. When a $CO+CO_2$ gases atmosphere is employed, oxides are formed first and then carbides are formed, and the result is a mixture of oxides and carbides. In these carburizing atmospheres, the carbon potential (CP) of the RX gases is the index which is the easiest to control so as to control the reaction. Thus, the CP is controlled to be about 0.2–0.5 for the reaction to take place at 800°–1100° C. for 10–60 minutes. Such a carbon potential (CP) is rather low compared with that employed for carrying out carburizing of steel.

Furthermore, it is desirable to apply reduction to the particles when oxides particles are dispersed, since excess oxidation, i.e., surface oxidation, is usually taken place. It is also to be noted that since the reaction between the particles and atmosphere is carried out on the surface of the particles, it is advantageous to charge particles to a fluid bed or a packed bed having a depth of 30 mm or less in a reactive atmosphere.

A starting powder may be prepared by a rapid dispersion in which a molten steel having a ferritic steel composition is rapidly cooled by means of a gas atomizing process, liquid atomizing process, plasma rotating electrode process, or single roll-type or twin roll-type rapid cooling process, in which rapid cooling is carried out so as to prepare powder from a molten metal. So long as a cooling rate of $10^2$K/sec or higher can be achieved, there is no limitation regarding the cooling process and apparatus. However, in general an atomizing process is preferable.

Thus, in a still another embodiment of the present invention, a starting powder having an Fe—Cr ferritic steel composition is prepared from a molten steel by means of a rapid solidification process, the resulting powder is subjected to working such as extrusion with an extrusion ratio of 3 or more or rolling with a rolling ratio of 2 or more, the resulting worked member is further subjected to secondary recrystallization, and the rapid solidification is carried out under at least one of the following conditions (i) to (iii):

(i) the molten steel contains at least one easily nitrided element or Cr, and after supersaturating with nitrogen and/or oxygen, the molten steel the rapid solidification is carried out;

(ii) the molten steel contains at least one easily nitrided element or Cr, and the rapid solidification is carried out in the presence of a nitriding medium; and (iii) the molten steel contains at least one easily oxidized element or Cr, and the rapid solidification is carried out in the presence of an oxidizing medium.

Examples of the nitriding medium are a nitrogen-containing gas and nitrides such as FeN and CrN which are added as a raw material.

Examples of the oxidizing medium are an oxygen-containing gas and oxides such as $Fe_2O_3$ and $Cr0_2$ which are added as a raw material.

Thus, according to the present invention, in the process of rapid solidification the following reactions occur: (i) the easily oxidized element and easily nitrided element react with nitrogen or oxygen in an atmosphere or with nitrogen or oxygen contained in an atomizing medium, and/or (ii) these elements react with oxygen or nitrogen which is supersaturated in molten steel and enclosed in a solidified steel, when the resulting powder is heated before working. Fine nitride or oxide particles having a particle diameter of 5–50 nm are uniformly dispersed in a ferritic steel matrix.

A starting powder having a ferritic steel composition is then subjected to hot extrusion at a temperature of 1000°–1200° C. so as to introduce strains. Needless to say, working under warm or cold conditions will also be effective to introduce strains. The extrusion ratio is restricted to 3 or more in order to introduce a sufficient amount of strains during working.

Prior to extrusion, it is also possible to apply HIP, CIP, rolling, and forging, if necessary. It is important to perform extrusion as a final step of forming with an extrusion ratio of 3 or more in order to introduce a sufficient amount of strains. After extrusion, HIP, rolling, forging may be applied to the extrudate.

Instead of performing extrusion, as will be described in detail hereinafter, rolling with a rolling ratio of 2 or more may be applied.

A composite material formed through such heavy-duty working is then subjected to secondary recrystallization. Thermal conditions of the secondary recrystallization are determined after considering the type and number of matrix phases, or the type, amount, and particle size of dispersed particles. Preferred conditions include a temperature of 1100°–1400° C. and treating time of 0.5–2 hours. A preferred temperature is 1200°–1400° C.

The secondary recrystallization heat treatment means that carried out so as to align {111} planes in a plane perpendicular to a given direction. In other words, any heat treatment may be carried out so long as such an alignment can be achieved.

The thus-obtained composite material has a high degree of orientation of {111} planes in a plane perpendicular to a given direction, the degree of orientation being 30 times larger than that of equiaxial polycrystals in terms of X-ray diffraction intensity. When the intensity is smaller than 30 times that of equiaxial polycrystals, the Young's modulus of the resulting composite material is smaller than 25,000 kgf/mm$^2$. Whether the intensity is larger than 30 times the intensity of equiaxial polycrystals can be determined, in one example, by considering whether the ratio of {222} planes to {110} planes in a given direction, in terms of X-ray diffraction intensity, is 0.10 or larger.

This will be further described in detail.

Generally, a material to which lattice strains have been introduced by heavy-duty working such as extrusion and rolling has a fine structure. Primary recrystallization is started by a driving force caused by lattice strain energy upon heat treatment, and the structure is comprised of crystals totally free from lattice defects. After completion of primary recrystallization, the material is further subjected to heat treatment at a higher temperature and for a longer period of time so that coarsening of the primary recrystallized crystals is started by a driving force of grain boundary energy to form an extremely coarsened secondary recrystallized structure.

According to the present invention, in the course of a series of recrystallization steps, <110> texture for an extrudate turns to a <111> secondary recrystallization texture with an increase of the Young's modulus from about 22,000 kgf/mm$^2$ to about 29,000 kgf/mm$^2$.

Namely, according to the present invention, a material in which 0.2% by volume of $Y_2O_3$ particles are dispersed comprises a very fine crystal structure in the form of an extrudate, for example, and after heat treatment at 1200° C. for 1 hour, the secondary recrystallization takes place to produce coarsening of crystal grains and formation of <111> texture. Thus, the Young's modulus in the direction of extrusion is increased to 28,888 kgf/mm$^2$.

Heat treatment conditions for the secondary recrystallization are determined depending on the amount of dispersing particles and working conditions which have been applied. For example, when the extrusion was carried out at 1050° C. with an extrusion ratio of 10, the secondary recrystallization temperature is 1200° C. for the case in which 0.2% by volume of $Y_2O_3$ particles is incorporated, and it is 1300° C. for the case in which the particles in an amount of 0.5% by volume are incorporated. This is because the dispersed particles act as an inhibitor to prevent movement of grain boundaries during recrystallization, and the more the particles are present the more effective they are.

In addition, when the amount of the dispersed particles is 0.5% by volume, the lower the extrusion temperature and the higher the extrusion ratio the lower the recrystallization temperature. This is because the larger the lattice strain energy to be introduced, the lower the recrystallization temperature at which the recrystallization begins.

The degree of orientation of {111} planes or {110} planes in a given direction, i.e., an extrusion direction or rolling-width direction is described by the integrated intensity compared with that of equiaxial polycrystals. In an experiment, a reduced iron powder with a packing ratio of 65% and a density of 5.1 g/cm$^3$ is used as a standard sample to determine the intensity.

When the integrated intensity is determined, the X-ray integrated intensity for the {110} planes and {222} planes at peaks in the direction of extrusion is measured and expressed as $I_{110}$, $I_{222}$, respectively. In the same manner, the X-ray intensity is measured for the standard sample and expressed as $I^0_{110}$, $I^0_{222}$, respectively.

Thus, the integrated intensity ratio for the {110} planes is described by $I_{110}/I^o_{110}$, and that for the {222} planes is described by $I_{222}/I^o_{222}$.

Thus, according to the present invention, a high Young's modulus composite material having a Young's modulus of more than 25,000 kgf/mm$^2$, and mostly over 28,000 kgf/

$mm^2$ can be obtained.

According to the present invention, instead of extrusion, as already mentioned, rolling may be employed.

The present invention, therefore, provides a process for preparing a high Young's modulus composite material by applying working to a composite powder having a ferritic steel composition with dispersed particles, and then carrying out heat treatment, characterized in that the working includes rolling with a rolling ratio of 2 or more, and heat treatment is carried out at a temperature of 900°–1350° C. so as to effect the secondary recrystallization.

In this embodiment of the present invention, rolling is applied to a composite material having a ferritic steel composition together with dispersed particles, and the resulting rolled material is further subjected to secondary recrystallization heat treatment. A resulting composite material has an intensity of {111} planes aligned perpendicularly to the rolling-width direction, in terms of X-ray diffraction intensity, 10 times, preferably 30 times larger than that of equiaxial polycrystals. The intensity may be 10 times larger than that of equiaxial polycrystals when strength is markedly high.

The secondary recrystallization heat treatment should be distinguished from tempering, which is usually carried out at a temperature lower than 700° C. According to the present invention, the rolled product is heat treated at a temperature of 900°–1350° C. so as to perform secondary recrystallization. The secondary heat treatment causes coarsening of crystal grains which are aligned in the direction at which the material exhibits a high level of Young's modulus. Thus, the recrystallization means a phenomenon in which crystal grains aligned at a given direction grow and coarsen after completion of usual recovery and recrystallization. The secondary recrystallization therefore takes place at a temperature higher than the usual recovery and recrystallization. By utilizing this phenomenon, the <111> texture which is formed after rolling in the direction perpendicular to the rolling-width direction is made prominent, resulting in a secondary recrystallization texture which exhibits a high Young's modulus in a direction perpendicular to the rolling-width direction. It is concluded, therefore, that the secondary recrystallization of the present invention can be distinguished from a usual tempering treatment.

Furthermore, according to the present invention, especially when rolling is employed, a high level of strength can be achieved by dispersing fine particles, which is contrary to the prior art. The high Young's modulus steel plate of the present invention differs from that of the prior art in this respect, too.

The above-described texture structure can be described by the following formula:

<211>{011}

Surface hardening heat treatment is also effective in the present invention.

The surface hardening heat treatment which is effective in the present invention includes nitriding, carburizing, and soft-nitriding. Preferred ones are gas nitriding, ion nitriding, and tufftriding.

In the case of carburizing a surface hardening process is carried out by quenching an austenitic phase to change it into martensite. It is necessary to establish an austenitic phase at a temperature of about 900° C. by carrying out carburizing. However, the matrix phase is comprised of a ferritic phase, so it is necessary to restrict a steel composition to some extent so as to be able to establish an austenitic phase in the surface of an article to be treated during carburizing. For this purpose, the content of ferrite formers such as Cr, Al, and Si is reduced to as low a level as possible, so long as a ferritic phase is maintained within the body of the article.

The carburizing can be advantageously carried out under conditions including a temperature of 800°–1000° C., and time of 50 hours or less under a hydrocarbon gas-containing atmosphere.

The reason why the temperature is restricted to 800°–1000° C. is that in this range of temperature, the carbon content will easily increase to form an austenitic phase which can be quenched to form a hard martensite phase. The treatment time is restricted to 50 hours or less, since a long period of treatment time will result in excess carburizing, which causes embrittlement in the surface area. An example of the hydrocarbon gas-containing atmosphere is a mixture of $CH_4$ gas and a conversion gas (40% $N_2$-30% $H_2$-30% CO).

Quenching from a decarburizing temperature is carried out advantageously by oil-quenching. Water-quenching is also applicable, but the presence of a ferritic phase would cause occurrence of distortion and cracking upon quenching in water. It is also desirable that tempering be performed after quenching, usually at a temperature 200°–500° C., so as to stabilize a martensite phase and to remove residual stresses.

When nitriding, i.e., gas nitriding or ion nitriding or tufftriding is employed so as to effect surface hardening, contrary to the case of carburizing, there is no restriction with respect to the steel composition of the ferritic steel matrix.

It is preferable to carry out gas nitriding at a temperature of 500°–590° C. for 30–120 hours under a decomposed ammonia gas atmosphere (100% $NH_3$). The temperature is preferably restricted to 500°–590° C., in which range a large amount of nitrogen can be dissolved in the matrix and the diffusion rate thereof is also high. The treatment time is restricted to 120 hours or less, since a long period of treatment will result in excess nitriding, which causes embrittlement in the surface area.

Furthermore, it is preferable to carry out ion nitriding at a temperature of 450°–650° C. for 80 hours or less in an $H_2$—$N_2$ mixture gas atmosphere. The temperature is restricted to 450°– 650° C., in which range a large amount of nitrogen can be dissolved in the matrix and the diffusion rate thereof is also high. The treatment time is restricted to 80 hours or less, since a long period of treatment will result in excess nitriding which causes embrittlement in the surface area. A preferred gas atmosphere is a mixed gas atmosphere of $H_2$ and 25– 80% $N_2$ at a pressure of 1–7 torr.

It is preferable that a nitriding layer be 50–700 μm thick for both gas nitriding and ion nitriding. A thickness not smaller than 50 μm can give a satisfactory level of wear resistance for an extended period of time. Restriction of the thickness of the hardened surface to not larger than 700 μm is effective for preventing occurrence of cracking or chipping in the surface layer of the hardened surface.

Nitriding can be performed by tufftriding, i.e., nitriding with a salt-bath. The tufftriding is preferably carried out at a temperature of 500°–600° C. for 10 hours or less using a mixed salt-bath comprising KCN and KCNO. After tufftriding, oil-quenching or water-quenching is applicable. The temperature is restricted to 500°–600° C., in which range a large amount of nitrogen can be dissolved in the matrix and the diffusion rate thereof is also high. The treatment time is restricted to 10 hours or less, since a long period of treatment will result in excess nitriding, which causes embrittlement in the surface area. In the case of tufftriding, a nitriding layer is preferably 10–200 μm thick. A thickness not smaller than 10 μm can give a satisfactory level of wear resistance for an extended period of time. Restriction of the thickness of the hardened surface to not larger than 200 μm is effective for preventing occurrence of cracking or chipping in the surface layer of the hardened surface.

In addition, it is preferable to carry out soft nitriding, i.e., gas soft nitriding at a temperature of 540°–680° C. for 12 hours or less in an atmosphere comprising a mixture of $CH_4$gas and a conversion gas (40% $N_2$-30% $H_2$-30% CO).

The temperature is restricted to 540°–680° C., in which range a large amount of nitrogen can be dissolved in the matrix and the diffusion rate thereof is also high. The treatment time is restricted to 12 hours or less, since a long period of treatment will result in excess nitriding which causes embrittlement in the surface area. A preferred gas atmosphere is a mixed gas atmosphere of $NH_3$ and a conversion gas (40% $N_2$-30% $H_2$-30% CO).

It is preferable that a carburizing or carbo-nitriding layer be 100–1500 μm thick for both carburizing or gas soft nitriding. The thickness of the layer means the distance at which the Vicker's hardness reaches 500 when a hardness profile is obtained. A thickness of at least 100 μm can give a satisfactory level of wear resistance for an extended period of time. In contrast, restriction of the thickness of the hardened surface to at most 700 μm is effective for preventing cracking or chipping in the surface layer of the hardened surface.

Thus, when the composite material in the form of an article is attacked by an external force, the surface area of the material is subjected to the largest elastic deformation, and stresses are applied to the surface in the largest degree. So, if compressive residual stresses are imposed on the surface of the material by carburizing and/or nitriding, fatigue strength against repeated application of stresses can be improved. In addition, the composite material of the present invention has a high Young's modulus, and the amount of elastic deformation can be decreased, releasing stress concentrations in an interface between a surface hardening layer and the substrate body with an improved resistance to peeling-off of the surface hardening layer.

EXAMPLE 1

In this example the following dispersing particles and matrix powder were used.

$Y_2O_3$ particles (average particle size of about 0.02 μm)

$Al_2O_3$ particles (0.01. 0.015, 0.02, 0.06, 0.10 μm)

TiC, TiN, $TiB_2$, BN particles (each 0.02 μm)

SUS410L(Fe—13Cr) powder (average particle size of 100 μm)

Electrolytic Fe powder (100 μm), C (graphite) powder (3 μm)

Mn powder (about 10 μm), Ni powder (about 100 μm)

Cr powder (about 40 μm), Al powder (about 60 μm)

Mo powder (about 3 μm), W powder (about 2 μm)

Nb powder (about 50 μm), Ti powder (about 10 μm)

V powder (about 20 μm)

A starting composite powder was prepared with a ball mill of the attrition type. The overall alloy composition of the powder was controlled to give a ferritic phase as a whole. The resulting composite powder was processed by heavy-duty working, such as extrusion, HIP +extrusion, HIP +forging +extrusion, CIP+forging+extrusion, extrusion+forging, and extrusion+rolling. After such heavy-duty working, the resulting extrudate was subjected to heat treatment at a temperature of 1100°–1450° C. for 1 hour and then air cooled.

Test results are summarized in Tables 1 through 3 together with alloy compositions of the ferritic matrix and type of dispersed particles. Tables 1 and 2 show examples in which the matrix comprises Fe—13Cr steel powder, and Table 3 shows examples in which the matrix comprises 13–20% Cr steel composition with additional alloying elements.

The heat treatment conditions include generally a temperature of 1100°–1400° C. and a heating time of 0.5–2 hours. A preferred temperature range is about 1200°–1400° C. Needless to say, the conditions vary depending on the type, size and amount of dispersed particles and matrix. The smaller the particle size of the dispersed particles, the higher the intensity of {111} planes, resulting in a high Young's modulus for dispersed particles having an average particle diameter of up to 0.1 μm.

EXAMPLE 2

In this example, Example 1 was repeated except that the average particle size of the $Al_2O_3$ dispersing particles was 0.02, 0.06, 0.10 μm, and AlN dispersing particles having an average particle size of 0.02 μm were used, and that Fe—4Al alloy powder obtained by gas atomization (average particle size about 30 μm) was also used.

Test results are summarized in Tables 4 through 7 together with alloy compositions of the ferritic matrix and the type of dispersed particles. Tables 4 and 5 show examples in which the matrix comprises Fe—4Al steel composition, and Tables 6 and 7 show examples in which the matrix comprises 0–10% Al ferritic steel composition with additional alloying elements.

The resistance to oxidation was determined by observing the degree of surface oxidation after exposure to the atmospheric air at 600° C. for 200 hours. Test results were classified as excellent, good, or poor.

EXAMPLE 3

In this example, Example 2 was repeated except that Fe—22Cr—3Al alloy powder obtained by gas atomization (about 30 μm) was additionally used.

Test results are summarized in Tables 8–10 together with alloy compositions of the ferritic matrix and the type of dispersed particles. Tables 8 and 9 show examples in which the matrix comprises 22% Cr—3% Al steel composition, and Table 10 shows examples in which the matrix comprises 16–35% Cr—0–3% Al ferritic steel composition with additional alloying elements. Run Nos. 8, 9, 10, and 11 employ a gas-atomized powder of Fe—22Cr—3Al steel as a starting powder for the matrix. In the other cases elemental powders were mixed to prepare a starting powder.

In this example, 475° C. embrittlement was also checked on each sample, which was subjected to heating at 475° C. for 24 hours in atmospheric air, and then the Charpy impact value was again measured.

EXAMPLE 4

In this example, Example 2 was repeated except that Fe—3Si alloy powder obtained by gas atomization (particle diameter about 30 μm) was additionally used.

Test results are summarized in Tables 11–14 together with alloy compositions of the ferritic matrix and the type of dispersed particles. Tables 11 and 12 show examples in which the matrix comprises 3% Si steel composition, and Tables 13 and 14 show examples in which the matrix comprises 0.6–6% Si ferritic steel composition with additional alloying elements. Run Nos. 8, 9, 10, and 11 employ a gas-atomized powder of Fe— 3Si steel as a starting powder for the matrix. In the other cases elemental powders were mixed to prepare a starting powder.

In this example, in order to determine the effectiveness of the Si addition to a high Cr-high Al composition material with respect to oxidation resistance and heat resistance, the following oxidation test was performed.

Two types of samples having the alloy compositions (i) Fe—20Cr—4.5Al—0.5Ti—0.5$Y_2O_3$, and (ii) Fe—20Cr—4.5Al—0.5Ti—0.5$Y_2O_3$—1Si were prepared. A tensile test at 600° C. was performed to determine high temperature strength. Exposure to atmospheric air were performed at 600° C. for 200 hours to determine the resistance to oxidation by visual observation.

Test results show that sample (i) had a high temperature strength of 28 kgf/$mm^2$ and sample (ii) had a strength of 40 kgf/$mm^2$. This fact proves the effectiveness of the Si addition with respect to heat resistance. In addition, from the results of an exposure test at 600° C., it is apparent that sample (ii) exhibited improved resistance to oxidation compared with sample (i).

EXAMPLE 5

In this example, (i) a mixed powder of electrolytic Fe powder (average particle size of 100 μm, oxygen content of 0.08% ) and Cr powder (average particle size of 50 μm, oxygen content of 0.15% )(the ratio of Fe:Cr of the mixed powder was 87:13), (ii) Fe—13Cr steel powder (average particle size of 70 μm), and (iii) Fe—13Cr—2Al steel powder (average particle size of 70 μm) were used as ferritic matrix powders.

As additive elements or particles, at least one powder selected from the group of the powders of Al, Ti, Y, Si, Ce, Zr, Mg, Mn, $Fe_2O_3$, $Cr_2O_3$, $Y_2O_3$, and $Al_2O_3$ was used.

A starting composite powder was prepared with a ball mill of the attrition type. Mechanical alloying was effected while the powder wa being treated in the ball mill. The overall alloy composition of the powder was controlled to give a ferritic phase as a whole. The resulting composite powder containing mechanically alloyed particles was heated to 1150° C. and then processed by hot extrusion with an extrusion ratio of 5 or 10. After extrusion, the resulting extrudate was heat treated at 1350° C. for 1 hour and air cooled. A composite material having a high Young's modulus was obtained.

The Young's modulus in the extrusion direction was obtained using the vertical resonance method.

Test results are summarized in Table 15.

EXAMPLE 6

In this example, Example 5 was repeated except that as additive elements or particles, at least one powder selected from the group of powders of Al, Ti, Zr, Ta, Mg, V, Nb, Si, B, $Fe_4N$, $Cr_2N$, AlN and TiN was used. The secondary recrystallization was carried out at 1300° C. for 1 hour.

Test results are shown in Table 16.

EXAMPLE 7

(1) Dispersion of fine oxide particles:

An Ar-gas atomized powder (average particle size of 250 μm or less) was prepared from an Fe—14Cr molten steel containing a given amount of Ti, Zr, Al, Y, or the like by an Ar-gas atomization process. The thus-obtained Ar-atomized powder was then subjected to reactive heat treatment at 900° C. for 30 minutes in an $H_2$ gas atmosphere (dew point 20° C., or −70° C., $CO/CO_2=10^5$). The powder which had been oxidized in an $H_2$ gas atmosphere having a dew point of 20° C. was subjected to additional reductive heat treatment at 1000° C. for 60 minutes in an $H_2$ gas atmosphere having a dew point of −70° C.

The resulting composite powder was heated to 1050° C. and then hot-extruded with an extrusion ratio of 10, followed by secondary recrystallization at 1250° C. for 1 hour.

Oxides which were formed during the reactive heat treatment were determined with an analytical electron microscope.

Test results are shown in Table 17.

(2) Dispersion of fine nitride particles

A starting powder (average particle size of 500 μm or less) was prepared by means of ingot-making and grinding from an Fe—14Cr steel containing a given amount of Ti, Nb, Al, Y or the like. The resulting powder of Fe—14Cr steel was then subjected to a reactive heat treatment at 600° C. for 7 hour in an $NH_3$, or an $N_2+H_2$ or an $NH_3$+Ar gas atmosphere.

The resulting composite powder was heated to 1050° C. and then hot-extruded with an extrusion ratio of 10, followed by secondary recrystallization at 1250° C. for 1 hour.

Nitrides which were formed during the reactive heat treatment were determined with an analytical electron microscope.

Test results are shown in Table 18.

(3) Dispersion of fine carbide particles

An Ar-gas atomized powder (average particle size of 250 μm or less) was prepared from an Fe—14Cr steel containing a given amount of Ti, Zr, Nb, V, or the like. This Ar-atomized powder was then subjected to a carburizing heat treatment at 950° C. for 30 minutes in an RX gas atmosphere (CP=0.2, 0.4, 0.5) or an Ar +$CH_4$, or an Ar+$C_3OH$ gas atmosphere.

The resulting composite powder was heated to 1050° C. and then hot-extruded with an extrusion ratio of 10, followed by secondary recrystallization at 1250° C. for 1 hour.

Carbides which were formed during the reactive heat treatment were determined with an analytical electron microscope.

Test results are shown in Table 19.

EXAMPLE 8

In this example the following dispersing particles and matrix powder were used.

$Y_2O_3$ particles (average particle size of about 0.01 μm)

$Al_2O_3$ and AlN particles (each about 0.02 μm)

TiN particles (0.03 μm)

Electrolytic Fe powder (100 μm)

Si power (about 50 μm)

Ni powder (about 100 μm)

Cr powder (about 40 μm)

Al powder (about 60 μm)

A starting composite powder was prepared with a ball mill of the attrition type, in which mechanical alloying took place. The overall alloy composition of the powder was controlled to give a ferritic phase as a whole. The resulting composite powder was processed by extrusion. After extrusion, the resulting extrudate was subjected to heat treatment at 1300° C. for 1 hour and then air cooled.

Intensity of {111} planes in a plane perpendicular to an extruding direction of the resulting composite material of the present invention, in terms of X-ray diffraction integrated intensity, was 30 times larger than that of an equiaxial polycrystal. After surface grinding, surface hardening treatment including gas nitriding, ion nitriding, gas soft nitriding, tufftriding, and gas carburizing was performed.

The Young's modulus, surface hardness and hardening depth were determined on the resulting composite material of the present invention.

Test results are summarized in Tables 20 and 21.

EXAMPLE 9

In this example the following dispersing particles and matrix powder were used.

$Y_2O_3$ particles (average particle size of about 0.02 μm)

$Al_2)_3$ particles (0.02, 0.06, 0.10 μm)

TiC, TiN, $TiB_2$, BN, AlN particles (each 0.02 μm)

Electrolytic Fe powder (100 μm),

Cr powder (about 40 μm),

Al powder (about 60 μm)

Mo powder (about 3 μm)

A starting composite powder was prepared with a ball mill of the attrition type, in which mechanical alloying took place. The overall alloy composition of the powder was controlled to give a ferritic phase as a whole. The resulting composite powder was packed in a capsule, and the capsule was processed by heavy working, such as rolling, HIP+rolling, or CIP+rolling. After such heavy duty working, most of the resulting products were subjected to heat treatment at a temperature of 850°–1450° C. for 1 hour and then air cooled.

Intensity of {111} planes in a plane perpendicular to a rolling-width direction, Young's modulus, and tensile strength were determined on the resulting composite material of the present invention.

Test results are summarized in Tables 22 through 24, in which "MA" stands for mechanical alloying, an "MA & R" stands for mechanical alloying plus reactive dispersion, meaning that mechanical alloying was carried out on an Al-containing ferritic composition powder in an atmosphere containing oxygen or nitrogen. In addition, "air-atomization" or "$N_2$ gas-atomization" means air gas-atomization or $N_2$ gas atomization of a ferritic molten steel, followed by rapid solidification during which fine particles of $Al_2O_3$ and AlN are precipitated, respectively.

Table 25 shows test results of conventional examples in which dispersed particles are not incorporated. The tensile strength was as low as 65 kgf/mm$^2$.

EXAMPLE 10

In this example a starting powder was prepared by a rapid solidification process.

(1)Dispersion of fine nitride particles

An Fe—14Cr ferritic molten steel containing a given amount of Ti, Nb, Y, and the like was prepared in an $N_2$-containing atmosphere or an Ar gas-containing atmosphere. The resulting molten steel was subjected to gas atomization using $N_2$, $NH_3$, $N_2$+$H_2$, $N_2$+Ar, or liquified nitrogen as an atomizing medium. The resulting atomized powder was then subjected to preheating at 1000° C. for 1 hour and then to hot extrusion with an extrusion ratio of 10. After hot extrusion, secondary recrystallization was carried out at 1300° C. for 1 hour.

Test results are shown in Table 26, in which Run Nos. 12, and 14 show that incorporation of nitrogen in a molten steel prior to atomization was also effective to make a fine distribution of nitride particles.

(2) Distribution of fine oxide particles

An Fe—14Cr ferritic molten steel containing a given amount of Ti, Zr, Al, Y, and the like was prepared in an Ar+$H_2O$-containing atmosphere (dew point of 20° C.) or Ar gas-containing atmosphere. The resulting molten steel was subjected to gas atomization using air, $O_2$+Ar ($PO_2$=0.05 atm), water, Ar, or $N_2$ as an atomizing medium. The resulting atomized powder was then subjected to reduction treatment in hydrogen at 1100° C. for 1 hour. The reduced powder was preheated at 1000° C. for 1 hour followed by hot extrusion with an extrusion ratio of 10. After hot extrusion, secondary recrystallization was carried out at 1200° C. for 1 hour.

Test results are shown in Table 27, from which it is noted that incorporation of oxygen in a molten steel prior to atomization was also effective to make a fine distribution of oxide particles.

TABLE 1

| No. | Dispersing Particles Type | Size (μm) | Amount (vol %) | Dispersing Method | Working Conditions | Heat Treatment | {111} Intensity | $I_{222}/I_{110}$ | Young's Modulus (kgf/mm$^2$) | Sharpy Impact Value (kgf/cm$^2$) | Remarks |
|---|---|---|---|---|---|---|---|---|---|---|---|
| 1 | — | — | 0 | Ingot Making | Extrusion (1100° C., Extrusion Ratio 10) | 1350° C. × 1 hr AC | 2 | 0.01 | 21,500 | 12 | Comparative |
| 2 | $Y_2O_3$ | 0.02 | 0.5 | MA* | Extrusion (1100° C., Extrusion Ratio 10) | 1250° C. × 1 hr AC | >100 | 5.2 | 29,300 | 17 | Present Invention |
| 3 | " | " | 1.0 | " | Extrusion (1100° C., Extrusion Ratio 10) | 1300° C. × 1 hr AC | >100 | 3.6 | 29,500 | 14 | |
| 4 | " | " | 3.0 | " | Extrusion (1100° C., Extrusion Ratio 10) | 1350° C. × 1 hr AC | 100 | 1.3 | 28,300 | 10 | |
| 5 | $Al_2O_3$ | " | 1.0 | " | Extrusion (1100° C., Extrusion Ratio 10) | 1350° C. × 1 hr AC | 100 | 2.6 | 29,000 | 15 | |
| 6 | " | 0.06 | " | " | Extrusion (1100° C., Extrusion Ratio 10) | 1350° C. × 1 hr AC | 80 | 1.2 | 28,300 | 14 | |
| 7 | " | 0.10 | " | " | Extrusion (1100° C., Extrusion Ratio 10) | 1350° C. × 1 hr AC | 70 | 0.4 | 26,100 | 15 | |
| 8 | TIC | 0.02 | " | " | Extrusion (1100° C., | 1250° C. × | 70 | 0.3 | 25,200 | 16 | |

TABLE 1-continued

| No. | Dispersing Particles Type | Size (μm) | Amount (vol %) | Dispersing Method | Working Conditions | Heat Treatment | {111} Intensity | $I_{222}/I_{110}$ | Young's Modulus (kgf/mm$^2$) | Sharpy Impact Value (kgf/cm$^2$) | Remarks |
|---|---|---|---|---|---|---|---|---|---|---|---|
| | | | | | Extrusion Ratio 10) | 1 hr AC | | | | | |
| 9 | TiN | " | " | " | Extrusion (1100° C., Extrusion Ratio 10) | 1300° C. × 1 hr AC | 80 | 1.7 | 28,000 | 17 | |
| 10 | $TiB_2$ | " | " | " | Extrusion (1100° C., Extrusion Ratio 10) | 1350° C. × 1 hr AC | 100 | 3.1 | 28,600 | 18 | |
| 11 | BN | " | " | " | Extrusion (1100° C., Extrusion Ratio 10) | 1350° C. × 1 hr AC | 100 | 2.6 | 28,400 | 16 | |
| 12 | $Al_2O_3$ | " | " | " | Extrusion (1100° C., Extrusion Ratio 5) | 1350° C. × 1 hr AC | 90 | 2.9 | 29,000 | 15 | |
| 13 | " | " | " | " | Extrusion (1100° C., Extrusion Ratio 3) | ↓ | 80 | 1.9 | 28,000 | 14 | |
| 14 | " | " | " | " | Extrusion (1100° C., Extrusion Ratio 2) | ↓ | 25 | 0.08 | 24,500 | 10 | Comparative |
| 15 | " | " | " | " | Extrusion (1200° C., Extrusion Ratio 10) | ↓ | 70 | 2.1 | 28,000 | 16 | Present Invention |
| 16 | " | " | " | " | HIP(1100° C. × 1 hr, 2000 atm) →Extrusion(1100° C., Extrusion Ratio 10) | ↓ | 100 | 6.4 | 29,000 | 17 | |
| 17 | " | " | " | " | HIP(1100° C. × 1 hr, 2000 atm) →Forging(1100° C., Forging Ratio 2) →Extrusion(1100° C., Extrusion Ratio 5) | ↓ | 100 | 10.1 | 29,200 | 17 | |
| 18 | " | " | " | " | CIP(4000 atm) →Forging(1100° C., Forging Ratio 2) →Extrusion(1100° C., Extrusion Ratio 5) | ↓ | 100 | 2.9 | 28,900 | 15 | |

(Note)
*: Mechanical Alloying
Matrix Composition: F3—13Cr

TABLE 2

| No. | Dispersing Particles Type | Size (μm) | Amount (vol %) | Dispersing Method | Working Conditions | Heat Treatment | {111} Intensity | $I_{222}/I_{110}$ | Young's Modulus (kgf/mm$^2$) | Sharpy Impact Value (kgf/cm$^2$) | Remarks |
|---|---|---|---|---|---|---|---|---|---|---|---|
| 19 | $Al_2O_3$ | 0.02 | 1.0 | MA* | Extrusion(1100° C., Extrusion Ratio 5) →Forging(1100° C., Forging Ratio 2) | 1350° C. × 1 hr, AC | 80 | 1.7 | 28,600 | 17 | Present Invention |
| 20 | " | " | " | " | Extrusion(1100° C., Extrusion Ratio 5) →Rolling(1100° C., Rolling Ratio 2) | ↓ | 70 | 1.5 | 28,000 | 14 | |
| 21 | " | " | " | " | →Extrusion(1100° C., Extrusion Ratio 5) →Rolling(1100° C., Rolling Ratio 2) | ↓ | 80 | 2.0 | 28,400 | 13 | |
| 22 | " | " | " | Partial Oxidation | Extrusion (1100° C., Extrusion Ratio 10) | ↓ | 100 | 2.8 | 28,800 | 15 | |
| 23 | " | " | " | MA* | Extrusion (1100° C., Extrusion Ratio 10) | 1100° C. × 1 hr AC | 2 | 0.01 | 21,500 | 16 | Comparative |
| 24 | " | " | " | " | Extrusion (1100° C., Extrusion Ratio 10) | 1450° C. × 1 hr AC | 10 | 0.02 | 23,200 | 14 | |

(Note)
*: Mechanical Alloying
Matrix Composition: F3—13Cr

TABLE 3

| No. | Matrix Composition (wt %) C | Mn | Ni | Cr | Al | Mo/w | Nb, Ti V | O | N | Dispersed Particles Type (Vol %) | Amount, Size (μm) | {111} Intensity | $I_{222}/I_{110}$ | Young's Modulus ($kgf/mm^2$) | Sharpy Impact Value ($kgf/cm^2$) |
|---|---|---|---|---|---|---|---|---|---|---|---|---|---|---|---|
| 25 | 0.02 | — | — | 13 | — | — | — | 0.15 | 0.05 | 0.5 $Y_2O_3$ | 0.01 | >100 | 9.6 | 29,300 | 16 |
| 26 | 0.02 | — | — | 16 | — | — | — | 0.15 | 0.06 | ↓ | 0.02 | 100 | 10.9 | 29,100 | 11 |
| 27 | 0.02 | — | — | 20 | — | — | — | 0.15 | 0.07 | ↓ | 0.015 | 100 | 7.2 | 28,900 | 8 |
| 28 | 0.02 | — | — | 13 | 1.0 | — | — | 0.10 | 0.04 | 0.5 $Al_2O_3$ | 0.02 | 100 | 4.8 | 29,000 | 15 |
| 29 | 0.02 | — | — | 13 | 3.0 | — | — | 0.13 | 0.04 | ↓ | 0.01 | 70 | 3.9 | 27,300 | 14 |
| 30 | 0.02 | — | — | 13 | 4.5 | — | — | 0.15 | 0.04 | ↓ | 0.01 | 25 | 0.04 | 24,600 | 8 |
| 31 | 0.02 | — | — | 20 | 4.5 | — | 0.5 Ti | 0.14 | 0.04 | 0.5 $Y_2O_3$ | 0.015 | 80 | 2.9 | 28,500 | 7 |
| 32 | 0.10 | — | — | 13 | — | — | — | 0.10 | 0.04 | ↓ | 0.02 | 100 | 4.2 | 29,000 | 13 |
| 33 | 0.20 | — | — | 13 | — | — | — | 0.09 | 0.04 | ↓ | 0.02 | 70 | 2.1 | 28,000 | 10 |
| 34 | 0.02 | 1.0 | — | 13 | — | — | — | 0.11 | 0.04 | ↓ | 0.015 | 80 | 3.0 | 28,400 | 11 |
| 35 | 0.02 | — | 1.0 | 13 | — | — | — | 0.10 | 0.04 | ↓ | 0.01 | 80 | 4.1 | 28,300 | 16 |
| 36 | 0.02 | — | — | 13 | — | 2.5 Mo | — | 0.10 | 0.04 | ↓ | 0.01 | 100 | 7.0 | 29,000 | 13 |
| 37 | 0.02 | — | — | 13 | — | 3.0 W | — | 0.14 | 0.06 | ↓ | 0.02 | >100 | 3.1 | 29,300 | 13 |
| 38 | 0.02 | — | — | 13 | — | 5.0 W | — | 0.12 | 0.04 | ↓ | 0.015 | 100 | 2.6 | 28,900 | 10 |
| 39 | 0.02 | — | — | 13 | — | — | 1 Nb | 0.12 | 0.04 | ↓ | 0.01 | 90 | 2.1 | 28,800 | 14 |
| 40 | 0.02 | — | — | 13 | — | — | 3 Nb | 0.13 | 0.04 | ↓ | 0.015 | 80 | 1.8 | 28,400 | 11 |
| 41 | 0.02 | — | — | 13 | — | — | 1 Ti | 0.10 | 0.04 | ↓ | 0.01 | 100 | 3.8 | 29,300 | 16 |
| 42 | 0.02 | — | — | 13 | — | — | 2 Ti | 0.09 | 0.05 | ↓ | 0.02 | 100 | 4.3 | 29,100 | 12 |
| 43 | 0.02 | — | — | 13 | — | — | 1 V | 0.10 | 0.04 | ↓ | 0.015 | 100 | 5.4 | 29,400 | 14 |
| 44 | 0.02 | — | — | 13 | — | — | 2 V | 0.11 | 0.03 | ↓ | 0.01 | 80 | 6.1 | 28,700 | 11 |

Matrix Composition: bal. Fe, Working Conditions: Extrusion (1100° C., Extrusion Ratio 10), Heat Treatment: 1300° C. × 1 hr, AC

TABLE 4

| No. | Dispersing Particles Type | Size (μm) | Amount (vol %) | Dispersing Method | Working Conditions | Heat Treatment |
|---|---|---|---|---|---|---|
| 1 | — | — | 0 | Ingot Making | Extrusion (1100° C., Extrusion Ratio 10) | 1350° C. × 1 hr AC |
| 2 | $Y_2O_3$ | 0.02 | 0.5 | MA* | Extrusion (1100° C., Extrusion Ratio 10) | 1250° C. × 1 hr AC |
| 3 | " | " | 1.0 | " | Extrusion (1100° C., Extrusion Ratio 10) | 1300° C. × 1 hr AC |
| 4 | " | " | 3.0 | " | Extrusion (1100° C., Extrusion Ratio 10) | 1350° C. × 1 hr AC |
| 5 | $Al_2O_3$ | " | 1.0 | " | Extrusion (1100° C., Extrusion Ratio 10) | 1350° C. × 1 hr AC |
| 6 | " | 0.06 | " | " | Extrusion (1100° C., Extrusion Ratio 10) | 1350° C. × 1 hr AC |
| 7 | " | 0.10 | " | " | Extrusion (1100° C., Extrusion Ratio 10) | 1350° C. × 1 hr AC |
| 8 | TiC | 0.02 | " | " | Extrusion (1100° C., Extrusion Ratio 10) | 1250° C. × 1 hr AC |
| 9 | AlN | " | " | " | Extrusion (1100° C., Extrusion Ratio 10) | 1300° C. × 1 hr AC |
| 10 | $TiB_2$ | " | " | " | Extrusion (1100° C., Extrusion Ratio 10) | 1350° C. × 1 hr AC |
| 11 | BN | " | " | " | Extrusion (1100° C., Extrusion Ratio 10) | 1350° C. × 1 hr AC |
| 12 | $Al_2O_3$ | " | " | " | Extrusion (1100° C., Extrusion Ratio 5) | 1350° C. × 1 hr AC |
| 13 | " | " | " | " | Extrusion (1100° C., Extrusion Ratio 3) | ↓ |
| 14 | " | " | " | " | Extrusion (1100° C., Extrusion Ratio 2) | ↓ |
| 15 | " | " | " | " | Extrusion (1200° C., Extrusion Ratio 10) | ↓ |
| 16 | " | " | " | " | HIP(1100° C. × 1 hr, 2000 atm) →Extrusion(1100° C., Extrusion Ratio 10) | ↓ |
| 17 | " | " | " | " | HIP(1100° C. × 1 hr, 2000 atm) →Forging(1100° C., Forging Ratio 2) →Extrusion(1100° C., Extrusion Ratio 5) | ↓ |
| 18 | " | " | " | " | CIP(4000 atm) →Forging(1100° C., Forging Ratio 2) →Extrusion(1100° C., Extrusion Ratio 5) | ↓ |

| No. | {111} Intensity | $I_{222}/I_{110}$ | Young's Modulus ($kgf/mm^2$) | Sharpy Impact Value ($kgf/cm^2$) | T.S. ($kgf/cm^2$) | Oxidation Resistance | Remarks |
|---|---|---|---|---|---|---|---|
| 1 | 0.8 | 0.01 | 20,300 | 9 | 80 | Good | Comparative |
| 2 | 90 | 1.0 | 28,200 | 12 | 90 | Excellent | Present |
| 3 | >100 | 2.1 | 29,600 | 12 | 95 | " | Invention |
| 4 | 100 | 1.6 | 29,000 | 14 | 103 | Good | |
| 5 | 100 | 2.8 | 28,800 | 9 | 98 | " | |
| 6 | 90 | 1.9 | 28,000 | 14 | 95 | Excellent | |
| 7 | 70 | 0.6 | 27,600 | 10 | 92 | Good | |
| 8 | 60 | 0.6 | 27,200 | 14 | 94 | " | |
| 9 | >100 | 3.2 | 28,500 | 10 | 99 | " | |
| 10 | 80 | 1.5 | 27,600 | 12 | 91 | " | |
| 11 | 50 | 0.8 | 26,700 | 11 | 98 | Excellent | |
| 12 | >100 | 2.4 | 28,200 | 13 | 101 | Good | |

TABLE 4-continued

| | | | | | | | |
|---|---|---|---|---|---|---|---|
| 13 | 70 | 0.9 | 27,900 | 11 | 98 | Excellent | |
| 14 | 20 | 0.05 | 24,800 | 10 | 68 | Good | Comparative |
| 15 | 70 | 0.7 | 28,200 | 13 | 93 | " | Present |
| 16 | >100 | 3.8 | 28,700 | 14 | 95 | " | Invention |
| 17 | >100 | 6.2 | 28,100 | 14 | 94 | Excellent | |
| 18 | 100 | 2.9 | 28,300 | 9 | 97 | Good | |

(Note)
*: Mechanical Alloying
Matrix Composition: Fe—4Al

TABLE 5

| | Dispersing Particles | | | | | |
|---|---|---|---|---|---|---|
| No. | Type | Size (μm) | Amount (vol %) | Dispersing Method | Working Conditions | Heat Treatment |
| 19 | $Al_2O_3$ | 0.02 | 1.0 | MA* | Extrusion (1100° C., Extrusion Ratio 5) →Forging(1100° C., Forging Ratio 2) | 1350° C. × 1 hr AC |
| 20 | " | " | " | " | Extrusion (1100° C., Extrusion Ratio 5) →Rolling(1100° C., Rolling Ratio 2) | ↓ |
| 21 | " | " | " | Partial Oxidation | Extrusion (1000° C., Extrusion Ratio 5) →Rolling(1100° C., Rolling Ratio 2) | ↓ |
| 22 | " | " | " | MA* | Extrusion (1100° C., Extrusion Ratio 10) | ↓ |
| 23 | " | " | " | " | Extrusion (1100° C., Extrusion Ratio 10) | 1100° C. × 1 hr AC |
| 24 | " | " | " | " | Extrusion (1100° C., Extrusion Ratio 10) | 1450° C. × 1 hr AC |

| No. | {111} Intensity | $I_{222}/I_{110}$ | Young's Modulus (kgf/mm$^2$) | Sharpy Impact Value (kgf/cm$^2$) | T.S. (kgf/cm$^2$) | Oxidation Resistance | Remarks |
|---|---|---|---|---|---|---|---|
| 19 | 80 | 1.8 | 27,900 | 14 | 92 | Good | Present |
| 20 | >100 | 2.6 | 29,800 | 9 | 90 | " | Invention |
| 21 | 100 | 1.8 | 29,100 | 12 | 94 | " | |
| 22 | 90 | 1.2 | 27,600 | 11 | 91 | Excellent | |
| 23 | 1 | 0.01 | 20,500 | 12 | 99 | Good | Comparative |
| 24 | 0.8 | 0.01 | 20,400 | 9 | 82 | " | |

(Note)
*: Mechanical Alloying
Matrix Composition: Fe—4Al

TABLE 6

| | Matrix Composition (wt %) | | | | | | | | | Dispersed Particles | | |
|---|---|---|---|---|---|---|---|---|---|---|---|---|
| No. | C | Mn | Ni | Cr | Al | Mo/w | Nb, Ti V | O | N | Amount, Type (Vol %) | Size (μm) | {111} Intensity |
| 25 | 0.02 | — | — | — | 0.0 | — | — | 0.15 | 0.05 | 0.2% $Y_2O_3$ | 0.01 | 2 |
| 26 | " | — | — | — | 3.0 | — | — | 0.11 | 0.04 | ↓ | 0.01 | 100 |
| 27 | " | — | — | — | 8.0 | — | — | 0.13 | 0.06 | ↓ | 0.02 | 90 |
| 28 | " | — | — | — | 10 | — | — | 0.10 | 0.03 | ↓ | 0.08 | 20 |
| 29 | 0.10 | — | — | — | 4.0 | — | — | 0.13 | 0.07 | ↓ | 0.01 | 90 |
| 30 | 0.20 | — | — | — | 4.0 | — | — | 0.12 | 0.04 | ↓ | 0.03 | 90 |
| 31 | 0.02 | 1.0 | — | — | 4.0 | — | — | 0.15 | 0.04 | ↓ | 0.04 | 80 |
| 32 | " | — | 1.0 | — | 4.0 | — | — | 0.13 | 0.03 | ↓ | 0.01 | 100 |
| 33 | " | — | — | — | 4.0 | 2.5 Mo | — | 0.14 | 0.04 | ↓ | 0.02 | 90 |
| 34 | " | — | — | — | 4.0 | 3.0 W | — | 0.10 | 0.04 | ↓ | 0.015 | 100 |
| 35 | " | — | — | — | 4.0 | 5.0 W | — | 0.12 | 0.05 | ↓ | 0.02 | 90 |
| 36 | " | — | — | — | 4.0 | — | 1 Nb | 0.16 | 0.04 | ↓ | 0.01 | 80 |
| 37 | " | — | — | — | 4.0 | — | 1 Nb | 0.11 | 0.04 | ↓ | 0.015 | 60 |
| 38 | " | — | — | — | 4.0 | — | 1 Ti | 0.14 | 0.03 | ↓ | 0.01 | >100 |
| 39 | " | — | — | — | 4.0 | — | 2 Ti | 0.13 | 0.04 | ↓ | 0.01 | 100 |
| 40 | " | — | — | — | 4.0 | — | 1 V | 0.12 | 0.04 | ↓ | 0.015 | 70 |
| 41 | " | — | — | — | 4.0 | — | 2 V | 0.13 | 0.04 | ↓ | 0.02 | 70 |
| 42 | " | — | — | 3.0 | 4.0 | | — | 0.11 | 0.03 | ↓ | 0.02 | >100 |
| 43 | " | — | 2.0 | — | 3.2 | | — | 0.12 | 0.04 | ↓ | 0.02 | 50 |

| No. | $I_{222}/I_{110}$ | Young's Modulus (kgf/mm$^2$) | Sharpy Impact Value (kgf/cm$^2$) | T.S. (kgf/cm$^2$) | Oxidation Resistance | Remarks |
|---|---|---|---|---|---|---|
| 25 | 0.03 | 20,700 | 11 | 63 | Poor | Comparative |
| 26 | 3.8 | 29,400 | 12 | 90 | Good | Present |

TABLE 6-continued

| | | | | | | |
|---|---|---|---|---|---|---|
| 27 | 2.6 | 28,700 | 10 | 101 | Excellent | Invention |
| 28 | 0.08 | 22,800 | 7 | 68 | Good | Comparative |
| 29 | 1.8 | 27,900 | 11 | 92 | Excellent | Present |
| 30 | 2.1 | 27,800 | 12 | 95 | Good | Invention |
| 31 | 2.3 | 29,500 | 11 | 91 | Excellent | |
| 32 | 2.7 | 29,600 | 14 | 90 | " | |
| 33 | 1.6 | 28,900 | 10 | 105 | " | |
| 34 | 4.2 | 28,800 | 12 | 101 | " | |
| 35 | 2.8 | 28,100 | 11 | 108 | " | |
| 36 | 0.9 | 27,800 | 11 | 98 | Good | |
| 37 | 0.7 | 27,300 | 14 | 97 | " | |
| 38 | 5.3 | 29,700 | 11 | 93 | " | |
| 39 | 3.6 | 28,900 | 11 | 90 | " | |
| 40 | 1.8 | 27,200 | 12 | 97 | " | |
| 41 | 1.9 | 2,6900 | 10 | 95 | " | |
| 42 | 3.2 | 29,700 | 12 | 95 | Excellent | |
| 43 | 0.5 | 26,100 | 13 | 90 | Good | |

(Note)
Dispersing Method: Mechanical Alloying, Matrix Composition: bal. Fe,
Working Conditions: Extrusion (1100° C., Extrusion Ratio 10), Heat Treatment: 1300° C. × 1 hr, AC

TABLE 7

| | Matrix Composition (wt %) | | | | | | | | | Dispersed Particles | | |
|---|---|---|---|---|---|---|---|---|---|---|---|---|
| No. | C | Mn | Ni | Cr | Al | Mo/w | Nb, Ti V | O | N | Amount, Type (Vol %) | Size (μm) | {111} Intensity |
| 44 | 0.02 | — | — | 16.0 | 5.0 | — | — | 0.11 | 0.04 | 0.2% $Y_2O_3$ | 0.02 | >100 |
| 45 | " | — | — | " | " | — | — | 0.13 | 0.03 | 0.2% AlN | 0.01 | 100 |
| 46 | " | — | — | " | " | — | — | 0.11 | 0.03 | 0.2% TiN | 0.01 | 90 |
| 47 | " | — | — | " | " | — | — | 0.10 | 0.05 | 0.2% TiC | 0.03 | 100 |
| 48 | " | — | — | " | " | — | — | 0.11 | 0.03 | 0.2% $TiB_2$ | 0.015 | 100 |
| 49 | " | — | — | " | " | — | — | 0.12 | 0.04 | 0.2% BN | 0.02 | >100 |
| 50 | " | — | — | 20.0 | 4.5 | — | 0.5 | 0.14 | 0.04 | 0.5% $Y_2O_3$ | 0.015 | 80 |

| No. | $I_{222}/I_{110}$ | Young's Modulus (kgf/mm$^2$) | Sharpy Impact Value (kgf/cm$^2$) | T.S. (kgf/cm$^2$) | Oxidation Resistance | Remarks |
|---|---|---|---|---|---|---|
| 44 | 2.2 | 29,500 | 11 | 101 | Excellent | Present |
| 45 | 4.2 | 28,700 | 13 | 99 | " | Invention |
| 46 | 1.6 | 27,200 | 12 | 97 | Good | |
| 47 | 3.2 | 29,800 | 13 | 99 | " | |
| 48 | 3.5 | 28,700 | 12 | 100 | " | |
| 49 | 4.2 | 29,300 | 10 | 102 | Excellent | |
| 50 | 2.9 | 28,500 | 7 | 90 | Good | Comparative |

(Note)
Dispersing Method: Mechanical Alloying, Matrix Composition: bal. Fe,
Working Conditions: Extrusion (1100° C., Extrusion Ratio 10), Heat Treatment: 1300° C. × 1 hr, AC

TABLE 8

| | Dispersing Particles | | | | | |
|---|---|---|---|---|---|---|
| No. | Type | Size (μm) | Amount (vol %) | Dispersingg Method | Working Conditions | Heat Treatment |
| 1 | — | — | 0 | Ingot Making | Extrusion (1100° C., Extrusion Ratio 10) | 1350° C. × 1 hr AC |
| 2 | $Y_2O_3$ | 0.02 | 0.5 | MA* | Extrusion (1100° C., Extrusion Ratio 10) | 1250° C. × 1 hr AC |
| 3 | " | " | 1.0 | " | Extrusion (1100° C., Extrusion Ratio 10) | 1300° C. × 1 hr AC |
| 4 | " | " | 3.0 | " | Extrusion (1100° C., Extrusion Ratio 10) | 1350° C. × 1 hr AC |
| 5 | $Al_2O_3$ | " | 1.0 | " | Extrusion (1100° C., Extrusion Ratio 10) | 1350° C. × 1 hr AC |
| 6 | " | 0.06 | " | " | Extrusion (1100° C., Extrusion Ratio 10) | 1350° C. × 1 hr AC |
| 7 | " | 0.10 | " | " | Extrusion (1100° C., Extrusion Ratio 10) | 1350° C. × 1 hr AC |
| 8 | TiC | 0.02 | " | " | Extrusion (1100° C., Extrusion Ratio 10) | 1250° C. × 1 hr AC |
| 9 | AlN | " | " | " | Extrusion (1100° C., Extrusion Ratio 10) | 1300° C. × 1 hr AC |
| 10 | $TiB_2$ | " | " | " | Extrusion (1100° C., Extrusion Ratio 10) | 1350° C. × 1 hr AC |
| 11 | BN | " | " | " | Extrusion (1100° C., Extrusion Ratio 10) | 1350° C. × 1 hr AC |
| 12 | $Al_2O_3$ | " | " | " | Extrusion (1100° C., Extrusion Ratio 5) | 1350° C. × 1 hr AC |
| 13 | " | " | " | " | Extrusion (1100° C., Extrusion Ratio 3) | ↓ |
| 14 | " | " | " | " | Extrusion (1100° C., Extrusion Ratio 2) | ↓ |
| 15 | " | " | " | " | Extrusion (1200° C., Extrusion Ratio 10) | ↓ |

TABLE 8-continued

| | | | | | | |
|---|---|---|---|---|---|---|
| 16 | " | " | " | " | HIP(1100° C. × 1 hr, 2000 atm) →Extrusion(1100° C., Extrusion Ratio 10) | ↓ |
| 17 | " | " | " | " | HIP(1100° C. × 1 hr, 2000 atm) →Forging(1100° C., Forging Ratio 2) →Extrusion(1100° C., Extrusion Ratio 5) | ↓ |
| 18 | " | " | " | " | CIP(4000 atm) →Forging(1100° C., Forging Ratio 2) →Extrusion(1100° C., Extrusion Ratio 5) | ↓ |

| No. | {111} Intensity | $I_{22}/I_{110}$ | Young's Modulus (kgf/mm²0 | Sharpy** Impact Value (kgf/cm²) | Sharpy*** Impact Value (kfg/cm²) | Remarks |
|---|---|---|---|---|---|---|
| 1 | 0.7 | 0.02 | 20,100 | 10 | 10 | Comparative |
| 2 | 100 | 3.7 | 29,200 | 10 | 9 | Present |
| 3 | 90 | 1.7 | 28,500 | 11 | 11 | Invention |
| 4 | 100 | 2.8 | 29,500 | 11 | 10 | |
| 5 | >100 | 4.2 | 29,600 | 10 | 11 | |
| 6 | 80 | 1.6 | 27,500 | 9 | 9 | |
| 7 | 90 | 1.6 | 27,900 | 11 | 10 | |
| 8 | 100 | 4.5 | 28,400 | 11 | 11 | |
| 9 | 90 | 2.5 | 27,100 | 10 | 9 | |
| 10 | 80 | 1.1 | 27,400 | 11 | 9 | |
| 11 | 60 | 1.0 | 26,200 | 10 | 10 | |
| 12 | 100 | 2.3 | 29,200 | 10 | 11 | |
| 13 | 90 | 1.7 | 27,400 | 11 | 10 | |
| 14 | 15 | 0.03 | 24,000 | 9 | 10 | Comparative |
| 15 | 80 | 1.2 | 27,200 | 10 | 11 | Present |
| 16 | 90 | 1.5 | 27,700 | 10 | 9 | Invention |
| 17 | 100 | 2.1 | 28,700 | 11 | 11 | |
| 18 | >100 | 3.4 | 29,100 | 11 | 10 | |

(Note)
*: Mechanical Alloying (MA)?
**: After Secondary Recrystallization?
***: Determined at room temperatures after heating at 475° C. for 24 hours following the secondary Recrystallization.
Matrix Composition: Fe—22Cr—3Al

TABLE 9

| No. | Dispersing Particles Type | Size (μM) | Amount (vol %) | Dispersing Method | Working Conditions | Heat Treatment |
|---|---|---|---|---|---|---|
| 19 | $Al_2O_3$ | 0.02 | 1.0 | MA * | Extrusion(1100° C., Extrusion Ratio 5) →Forging (1100° C., Forging Ratio 2) | 1350° C. × 1 hr, AC |
| 20 | " | " | " | " | Extrusion(1100° C., Extrusion Ratio 5) →Rolling(1100° C., Rolling Ratio 2) | ↓ |
| 21 | " | " | " | " | Extrusion(1100° C., Extrusion Ratio 5) →Rolling(1100° C., Rolling Ratio 2) | ↓ |
| 22 | " | " | " | Partial Oxidation | Extrusion(1100° C., Extrusion Ratio 10) | ↓ |
| 23 | " | " | " | MA | Extrusion(1100° C., Extrusion Ratio 10) | 1100° C. × 1 hr, AC |
| 24 | " | " | " | " | Extrusion(1100° C., Extrusion Ratio 10) | 1450° C. × 1 hr, AC |

| No. | {111} Intensity | $I_{222}/I_{110}$ | Young's Modulus (kgf/mm²) | Sharpy** Impact Value (kgf/cm²) | Sharpy*** Impact Value (kgf/cm²) | Remarks |
|---|---|---|---|---|---|---|
| 19 | 90 | 1.5 | 27,200 | 11 | 10 | Present |
| 20 | 100 | 3.0 | 28,400 | 10 | 10 | Invention |
| 21 | >100 | 4.2 | 29,300 | 10 | 11 | |
| 22 | 100 | 2.8 | 28,300 | 11 | 9 | |
| 23 | 0.5 | 0.01 | 20,000 | 9 | 9 | Comparative |
| 24 | 0.6 | 0.01 | 20,100 | 8 | 9 | |

(Note)
*: Mechanical Alloying (MA)
**: After Secondary Recrystallization
***: Determined at room temperatures after heating at 475° C. for 24 hours following the secondary Recrystallization.
Matrix Composition: Fe—22Cr—3Al

TABLE 10

| | Matrix Composition (wt %) | | | | | | | | | Dispersed Particles | |
|---|---|---|---|---|---|---|---|---|---|---|---|
| No. | C | Mn | Ni | Cr | Al | Mo/W | Nb, Ti V | O | N | Amount, Type (Vol. %) | Size (μm) |
| 25 | 0.02 | — | — | 20 | — | — | — | 0.11 | 0.04 | 0.2% $Al_2O_3$ | 0.01 |
| 26 | 0.02 | — | — | 20 | 1.0 | — | — | 0.12 | 0.04 | ↓ | 0.01 |
| 27 | 0.02 | — | — | 20 | 3.0 | — | — | 0.10 | 0.03 | ↓ | 0.02 |
| 28 | 0.02 | — | — | 20 | 4.0 | — | — | 0.15 | 0.05 | 0.2% $Y_2O_3$ | 0.03 |
| 29 | 0.02 | — | — | 20 | 10 | — | — | 0.12 | 0.05 | ↓ | 0.20 |
| 30 | 0.10 | — | — | 20 | 3.0 | — | — | 0.11 | 0.03 | ↓ | 0.01 |
| 31 | 0.20 | — | — | 20 | 3.0 | — | — | 0.14 | 0.05 | ↓ | 0.01 |
| 32 | 0.02 | 1.0 | — | 20 | 3.0 | — | — | 0.15 | 0.03 | ↓ | 0.02 |
| 33 | 0.02 | — | 1.0 | 20 | 3.0 | — | — | 0.14 | 0.04 | ↓ | 0.02 |
| 34 | 0.02 | — | — | 20 | 3.0 | 2.5 Mo | — | 0.10 | 0.03 | ↓ | 0.01 |
| 35 | 0.02 | — | — | 20 | 3.0 | 3.0 W | — | 0.16 | 0.06 | ↓ | 0.01 |
| 36 | 0.02 | — | — | 20 | 3.0 | 5.0 W | — | 0.10 | 0.04 | ↓ | 0.01 |
| 37 | 0.02 | — | — | 20 | 3.0 | — | 1 Nb | 0.13 | 0.04 | ↓ | 0.02 |
| 38 | 0.02 | — | — | 20 | 3.0 | — | 3 Nb | 0.14 | 0.05 | ↓ | 0.01 |
| 39 | 0.02 | — | — | 20 | 3.0 | — | 1 Ti | 0.14 | 0.04 | ↓ | 0.02 |
| 40 | 0.02 | — | — | 20 | 3.0 | — | 2 Ti | 0.17 | 0.05 | ↓ | 0.01 |
| 41 | 0.02 | — | — | 20 | 3.0 | — | 1 V | 0.13 | 0.04 | ↓ | 0.02 |
| 42 | 0.02 | — | — | 20 | 3.0 | — | 2 V | 0.14 | 0.04 | ↓ | 0.01 |
| 43 | 0.02 | — | 2.0 | 18 | 3.0 | — | — | 0.14 | 0.03 | ↓ | 0.01 |
| 44 | 0.02 | — | — | 18 | 3.0 | — | — | 0.10 | 0.03 | 0.2% $Al_2O_3$ | 0.01 |
| 45 | 0.02 | — | — | 20 | 3.0 | — | — | 0.15 | 0.04 | 0.2% AlN | 0.01 |
| 46 | 0.02 | — | — | 22 | 3.0 | — | — | 0.16 | 0.06 | 0.2% TiN | 0.02 |
| 47 | 0.02 | — | — | 24 | 3.0 | — | — | 0.11 | 0.03 | 0.2% TiC | 0.02 |
| 48 | 0.02 | — | — | 26 | 3.0 | — | — | 0.16 | 0.04 | 0.2% $TiB_2$ | 0.02 |
| 49 | 0.02 | — | — | 28 | 3.0 | — | — | 0.13 | 0.05 | 0.2% BN | 0.02 |
| 50 | 0.02 | — | — | 20 | 4.5 | — | — | 0.13 | 0.05 | 0.5% $Y_2O_3$ | 0.03 |
| 51 | 0.02 | — | — | 20 | 4.5 | — | 0.5 Ti | 0.14 | 0.04 | 0.5% $Y_2O_3$ | 0.015 |

| No. | {111} Intensity | $I_{222}/I_{110}$ | Young's Modulus (kgf/mm$^2$) | Sharpy* Impact Value (kgf/cm$^2$) | Sharpy** Impact Value (kgf/cm$^2$) | Remarks |
|---|---|---|---|---|---|---|
| 25 | 90 | 1.5 | 28,200 | 11 | 11 | Present |
| 26 | 100 | 1.8 | 28,800 | 11 | 10 | Invention |
| 27 | >100 | 4.0 | 29,100 | 11 | 9 | |
| 28 | 100 | 2.5 | 28,400 | 10 | 8 | |
| 29 | 2 | 0.02 | 20,200 | 7 | 3 | Comparative |
| 30 | 100 | 3.0 | 28,600 | 11 | 11 | Present |
| 31 | 70 | 1.2 | 27,100 | 9 | 11 | Invention |
| 32 | 90 | 1.4 | 28,600 | 10 | 11 | |
| 33 | 100 | 2.3 | 28,600 | 10 | 9 | |
| 34 | 100 | 2.9 | 29,100 | 11 | 11 | |
| 35 | 90 | 1.7 | 27,400 | 11 | 11 | |
| 36 | 100 | 2.5 | 28,700 | 10 | 11 | |
| 37 | 90 | 1.3 | 27,200 | 11 | 10 | |
| 38 | 70 | 1.1 | 27,300 | 9 | 10 | |
| 39 | 100 | 2.7 | 29,200 | 10 | 9 | |
| 40 | >100 | 4.8 | 29,600 | 11 | 12 | |
| 41 | 90 | 1.5 | 28,500 | 11 | 11 | |
| 42 | 80 | 1.4 | 27,300 | 10 | 10 | |
| 43 | 50 | 0.4 | 26,200 | 9 | 10 | |
| 44 | 90 | 1.1 | 27,300 | 10 | 10 | |
| 45 | 100 | 2.4 | 29,000 | 10 | 11 | |
| 46 | 100 | 1.9 | 28,300 | 11 | 10 | |
| 47 | 90 | 1.3 | 27,100 | 10 | 10 | |
| 48 | 80 | 1.5 | 26,700 | 9 | 11 | |
| 49 | 100 | 2.6 | 29,100 | 9 | 8 | |
| 50 | 80 | 1.1 | 26,100 | 7 | 3 | Comparative |
| 51 | 80 | 2.9 | 28,500 | 7 | 2 | |

(Note)
*: After Secondary Recrystallization
**: Determined at room temperatures after heating at 475° C. for 24 hours following the secondary Recrystallization.
Dispersing Method: Mechanical Alloying, Matrix Composition: bal. Fe,
Working Conditions: Extrusion (1100° C., Extrusion Ratio 10), Heat Treatment: 1300° C. × 1 hr, AC

TABLE 11

| No. | Dispersing Particles Type | Size (μm) | Amount (vol %) | Dispersing Method | Working Conditions | Heat Treatment | {111} Intensity | $I_{222}/I_{110}$ | Young's Modulus (kgf/mm$^2$) | Remarks |
|---|---|---|---|---|---|---|---|---|---|---|
| 1 | — | — | 0 | Ingot Making | Extrusion(1100° C., Extrusion Ratio 10) | 1350° C. × 1 hr, AC | 0.6 | 0.01 | 19,900 | Comparative |
| 2 | $Y_2O_3$ | 0.02 | 0.5 | MA * | Extrusion(1100° C., Extrusion Ratio 10) | 1250° C. × 1 hr, AC | >100 | 1.2 | 28,300 | Present Invention |
| 3 | " | " | 1.0 | " | Extrusion(1100° C., Extrusion Ratio 10) | 1300° C. × 1 hr, AC | 100 | 2.2 | 28,200 | |
| 4 | " | " | 3.0 | " | Extrusion(1100° C., Extrusion Ratio 10) | 1350° C. × 1 hr, AC | 90 | 1.8 | 28,700 | |
| 5 | $Al_2O_3$ | " | 1.0 | " | Extrusion(1100° C., Extrusion Ratio 10) | 1350° C. × 1 hr, AC | 100 | 4.2 | 28,800 | |
| 6 | " | 0.06 | " | " | Extrusion(1100° C., Extrusion Ratio 10) | 1350° C. × 1 hr, AC | 100 | 2.9 | 27,400 | |
| 7 | " | 0.10 | " | " | Extrusion(1100° C., Extrusion Ratio 10) | 1350° C. × 1 hr, AC | 80 | 0.6 | 27,100 | |
| 8 | TiC | 0.02 | " | " | Extrusion(1100° C., Extrusion Ratio 10) | 1250° C. × 1 hr, AC | 70 | 0.7 | 27,700 | |
| 9 | AlN | " | " | " | Extrusion(1100° C., Extrusion Ratio 10) | 1300° C. × 1 hr, AC | 90 | 1.2 | 28,300 | |
| 10 | $TiB_2$ | " | " | " | Extrusion(1100° C., Extrusion Ratio 10) | 1350° C. × 1 hr, AC | 70 | 1.3 | 27,600 | |
| 11 | BN | " | " | " | Extrusion(1100° C., Extrusion Ratio 10) | 1350° C. × 1 hr, AC | 50 | 0.4 | 26,400 | |
| 12 | $Al_2O_3$ | " | " | " | Extrusion(1100° C., Extrusion Ratio 5) | 1350° C. × 1 hr, AC | 90 | 1.0 | 28,900 | |
| 13 | " | " | " | " | Extrusion(1100° C., Extrusion Ratio 3) | ↓ | 80 | 1.6 | 27,600 | |
| 14 | " | " | " | " | Extrusion(1100° C., Extrusion Ratio 2) | ↓ | 15 | 0.07 | 24,200 | Comparative |
| 15 | " | " | " | " | Extrusion(1200° C., Extrusion Ratio 10) | ↓ | 70 | 0.9 | 28,200 | Present Invention |
| 16 | " | " | " | " | HIP(1100° C. × 1hr, 2000 atm) →Extrusion(1100° C., Extrusion Ratio 10) | ↓ | 100 | 4.9 | 28,900 | |
| 17 | " | " | " | " | HIP(1100° C. × 1hr, 2000 atm) →Forging(1100° C., Forging Ratio 2) →Extrusion(1100° C., Extrusion Ratio 5) | ↓ | >100 | 8.3 | 29,300 | |
| 18 | " | " | " | " | CIP(4000 atm) →Forging(1100° C., Forging Ratio 2) →Extrusion(1100° C., Extrusion Ratio 5) | ↓ | 90 | 1.6 | 27,600 | |

(Note)
*: Mechanical Alloying
Matrix Composition: Fe—3Si

TABLE 12

| No. | Dispersing Particles Type | Size (μm) | Amount (vol %) | Dispersing Method | Working Conditions | Heat Treatment | {111} Intensity | $I_{222}/I_{110}$ | Young's Modulus (kgf/mm$^2$) | Remarks |
|---|---|---|---|---|---|---|---|---|---|---|
| 19 | $Al_2O_3$ | 0.02 | 1.0 | MA * | Extrusion(1100° C., Extrusion Ratio 5) →Forging(1100° C., Forging Ratio 2) | 1350° C. × 1 hr, AC | 90 | 0.9 | 28,000 | Present Invention |
| 20 | " | " | " | " | Extrusion(1100° C., Extrusion Ratio 5) →Rolling(1100° C., Rolling Ratio 2) | ↓ | 100 | 1.6 | 28,700 | |
| 21 | " | " | " | " | Extrusion(1100° C., Extrusion Ratio 5) →Rolling(1100° C., Rolling Ratio 2) | ↓ | 90 | 1.2 | 27,900 | |
| 22 | " | " | " | Partial | Extrusion(1100° C., | ↓ | 100 | 2.8 | 28,200 | |

TABLE 12-continued

| No. | Dispersing Particles Type | Size (μm) | Amount (vol %) | Dispersing Method | Working Conditions | Heat Treatment | {111} Intensity | $I_{222}/I_{110}$ | Young's Modulus (kgf/mm$^2$) | Remarks |
|---|---|---|---|---|---|---|---|---|---|---|
| 23 | " | " | " | Oxidation MA * | Extrusion Ratio 10) Extrusion(1100° C., Extrusion Ratio 10) | 1100° C. × 1 hr, AC | 0.5 | 0.01 | 20,000 | Comparative |
| 24 | " | " | " | " | Extrusion(1100° C., Extrusion Ratio 10) | 1450° C. × 1 hr, AC | 0.3 | 0.01 | 20,100 | |

(Note)
*: Mechanical Alloying
Matrix Composition: Fe—3Si

TABLE 13

| No. | Matrix Composition (wt %) C | Mn | Ni | Cr | Al | Si | Mo/w | Nb, Ti V | O | N | Dispersed Particles Amount, Type (Vol. %) | Size (μm) | {111} Intensity | $I_{222}/I_{110}$ | Young's Modulus (kgf/mm$^2$) | Remarks |
|---|---|---|---|---|---|---|---|---|---|---|---|---|---|---|---|---|
| 25 | 0.02 | — | — | — | — | 1.5 | — | — | 0.14 | 0.04 | 0.2% $Al_2O_3$ | 0.02 | 90 | 2.1 | 28,400 | Present |
| 26 | 0.02 | — | — | — | — | 3.0 | — | — | 0.11 | 0.04 | ↓ | 0.02 | >100 | 6.8 | 29,400 | Invention |
| 27 | 0.02 | — | — | — | — | 4.0 | — | — | 0.12 | 0.03 | ↓ | 0.04 | 80 | 1.2 | 27,200 | |
| 28 | 0.02 | — | — | — | — | 6.0 | — | — | 0.11 | 0.04 | ↓ | 0.07 | 20 | 0.03 | 20,300 | Comparative |
| 29 | 0.10 | — | — | — | — | 3.0 | — | — | 0.13 | 0.05 | 0.2% $Y_2O_3$ | 0.02 | 100 | 1.9 | 28,200 | Present |
| 30 | 0.20 | — | — | — | — | 3.0 | — | — | 0.13 | 0.04 | ↓ | 0.01 | 100 | 2.4 | 28,700 | Invention |
| 31 | 0.02 | 1.0 | — | — | — | 3.0 | — | — | 0.16 | 0.04 | ↓ | 0.02 | 90 | 2.8 | 27,100 | |
| 32 | 0.02 | — | 1.0 | — | — | 3.0 | — | — | 0.12 | 0.04 | ↓ | 0.01 | 90 | 1.6 | 28,400 | |
| 33 | 0.02 | — | — | — | — | 3.0 | 2.5 Mo | — | 0.18 | 0.04 | ↓ | 0.02 | 70 | 0.9 | 28,100 | |
| 34 | 0.02 | — | — | — | — | 3.0 | 3.0 W | — | 0.13 | 0.03 | ↓ | 0.01 | 90 | 1.5 | 28,500 | |
| 35 | 0.02 | — | — | — | — | 3.0 | 5.0 W | — | 0.12 | 0.04 | ↓ | 0.03 | 100 | 2.9 | 29,500 | |
| 36 | 0.02 | — | — | — | — | 3.0 | — | — | 0.14 | 0.04 | ↓ | 0.01 | 80 | 0.7 | 27,700 | |
| 37 | 0.02 | — | — | — | — | 3.0 | — | 1 Nb | 0.12 | 0.04 | ↓ | 0.02 | 100 | 1.7 | 28,300 | |
| 38 | 0.02 | — | — | — | — | 3.0 | — | 3 Nb | 0.17 | 0.05 | ↓ | 0.01 | 90 | 1.1 | 29,600 | |
| 39 | 0.02 | — | — | — | — | 3.0 | — | 1 Ti | 0.13 | 0.03 | ↓ | 0.01 | >100 | 4.8 | 29,800 | |
| 40 | 0.02 | — | — | — | — | 3.0 | — | 2 Ti | 0.13 | 0.04 | ↓ | 0.01 | 90 | 1.2 | 27,000 | |
| 41 | 0.02 | — | — | — | — | 3.0 | — | 1 V | 0.15 | 0.03 | ↓ | 0.02 | 80 | 0.9 | 28,700 | |
| 42 | 0.02 | — | — | 3.0 | — | 3.0 | — | 2 V | 0.14 | 0.04 | ↓ | 0.01 | 100 | 2.5 | 29,100 | |
| 43 | 0.02 | — | — | — | — | 0.6 | — | — | 0.11 | 0.04 | ↓ | 0.02 | 45 | 0.6 | 25,900 | |
| 44 | 0.02 | — | 2.0 | — | — | 0.6 | — | — | 0.10 | 0.04 | ↓ | 0.02 | 40 | 0.5 | 25,400 | |
| 45 | 0.02 | — | — | 28.0 | — | 1.5 | — | — | 0.13 | 0.03 | 0.2% $Al_2O_3$ | 0.01 | 100 | 7.2 | 29,200 | |

(Note)
Dispersing Method: Mechanical Alloying, Matrix Composition: bal. Fe, Working Conditions: Extrusion (1100° C., Extrusion Ratio 10), Heat Treatment: 1300° C., × 1 hr, AC

TABLE 14

| No. | Matrix Composition (wt %) C | Mn | Ni | Cr | Al | Si | Mo/w | Nb, Ti V | O | N | Dispersed Particles Amount, Type (Vol. %) | Size (μm) | {111} Intensity | $I_{222}/I_{110}$ | Young's Modulus (kgf/mm$^2$) | Remarks |
|---|---|---|---|---|---|---|---|---|---|---|---|---|---|---|---|---|
| 46 | 0.02 | — | — | 24.0 | — | 1.5 | — | — | 0.11 | 0.04 | 0.2% AlN | 0.01 | >100 | 8.3 | 29,700 | Present |
| 47 | 0.02 | — | — | 20.0 | — | 1.5 | — | — | 0.12 | 0.03 | 0.2% TiN | 0.01 | 100 | 3.6 | 28,600 | Invention |
| 48 | 0.02 | — | — | 16.0 | — | 1.5 | — | — | 0.10 | 0.04 | 0.2% TiC | 0.02 | >100 | 3.5 | 29,500 | |
| 49 | 0.02 | — | — | 12.0 | — | 1.5 | — | — | 0.10 | 0.04 | 0.2% $TiB_2$ | 0.01 | 80 | 1.2 | 27,400 | |
| 50 | 0.02 | — | — | 8.0 | — | 1.5 | — | — | 0.12 | 0.03 | 0.2% BN | 0.03 | 90 | 2.8 | 27,800 | |
| 51 | 0.02 | — | — | — | 2.0 | 0.6 | — | — | 0.15 | 0.03 | 0.2% $Al_2O_3$ | 0.01 | 100 | 3.8 | 29,300 | |
| 52 | 0.02 | — | — | — | 6.0 | 0.6 | — | — | 0.14 | 0.03 | 0.2% $Al_2O_3$ | 0.01 | 90 | 1.2 | 27,400 | |
| 53 | 0.02 | — | — | 18.0 | 5.0 | 0.6 | — | — | 0.10 | 0.04 | 0.2% $Al_2O_3$ | 0.01 | 100 | 1.9 | 28,500 | |

(Note)
Dispersing Method: Mechanical Alloying, Matrix Composition: bal. Fe, Working Conditions: Extrusion (1100° C., Extrusion Ratio 10), Heat Treatment: 1300° C., × 1 hr, AC

TABLE 15

| No. | Additives or Oxides | Amount (wt %) | Dispersed Particles | Particle Diameter (nm) | Young's Modulus ($kgf/mm^2$) | Remarks |
|---|---|---|---|---|---|---|
| 1 | Al | 2.0 | $Al_2O_3$ | 12 | 29,100 | Present |
| 2 | Al (in Matrix) | 2.0 | $Al_2O_3$ | 10 | 28,400 | Invention |
| 3 | Al | 2.0 | $Al_2O_3$ | 12 | 28,700 | |
| 4 | Al | 4.5 | $Al_2O_3$ | 20 | 28,900 | |
| 5 | Y | 1.0 | $Y_2O_3$ | 10 | 28,700 | |
| 6 | Ti | 3.0 | $TiO_2$ | 35 | 26,300 | |
| 7 | none | — | $Cr_2O_3$ | 20 | 27,300 | |
| 8 | Si | 3.0 | $SiO_2$ | 10 | 28,500 | |
| 9 | Ce | 3.0 | $CeO_2$ | 12 | 27,800 | |
| 10 | Zr | 3.0 | $ZrO_2$ | 20 | 27,600 | |
| 11 | Mg | 3.0 | MgO | 15 | 28,200 | |
| 12 | Mn | 3.0 | MnO | 10 | 27,600 | |
| 13 | Al Ti | 4.5 0.5 | $Al_xTi_yO$ | 25 | 28,900 | |
| 14 | Ti Y | 1.0 1.0 | $Ti_xY_yO$ | 35 | 27,100 | |
| 15 | Al Y | 4.5 0.5 | $Al_xY_yO$ | 20 | 28,900 | |
| 16 | Al $Fe_2O_3$ | 4.5 1.0 | $Al_2O_3$ | 15 | 27,300 | |
| 17 | Al $Cr_2O_3$ | 4.5 0.5 | $Al_2O_3$ | 10 | 27,500 | |
| 18 | Al $Fe_2O_3$ | 4.5 1.0 | $Al_2O_3$ | 12 | 27,300 | |
| 19 | Al $Cr_2O_3$ | 4.5 0.5 | $Al_2O_3$ | 15 | 27,500 | |
| 20 | $Y_2O_3$ (60 nm) | 0.5 | $Y_2O_3$ | 60 | 23,900 | Comparative |
| 21 | $Al_2O_3$ (60 nm) | 0.2 | $Al_2O_3$ | 60 | 23,500 | |
| 22 | $Al_2O_3$ (60 nm) | 0.2 | $Al_2O_3$ | 60 | 28,800 | |

(Note)
Matrix Composition: No. 1: Fe—13Cr (Alloy Powder)
No. 2: Fe—13Cr—2Al (Alloy Powder)
No. 3~22: Fe—13Cr (Elemental Powders)
Dispersion: No. 1~15: Mechanical Alloying (Ar-0.1% $O_2$)
No. 16, 17: $Fe_2O_3$, $Cr_2O_3$ Particles added Mechanical Alloying in Ar
No. 18, 19: $Fe_2O_3$, $Cr_2O_3$ Particles added Mechanical Alloying (Ar-0.1% $O_2$)
No. 20~22: Dispersing Particle Addition + Mechanical Alloying in Ar
Working: No. 1~21: Extrusion (Ratio: 5, Temp.: 1150° C.)
No. 22: Extrusion (Ratio: 10, Temp.: 1150° C.)
Heat Treatment: 1350° C. × 1 hr, AC

TABLE 16

| No. | Additives or Nitride | Amount (wt %) | Mechanical Alloying Atmosphere | Dispersed Particles | Particle Diameter (nm) | Young's Modulus (kgf/mm) | Remarks |
|---|---|---|---|---|---|---|---|
| 1 | Al | 2.0 | 100% $N_2$ | AlN | 12 | 27,700 | Present |
| 2 | Al (in Matrix) | 2.0 | 100% $N_2$ | AlN | 15 | 28,500 | Invention |
| 3 | Al | 2.0 | 100% $N_2$ | AlN | 12 | 28,100 | |
| 4 | Al | 2.0 | Ar-20% $N_2$ | AlN | 10 | 28,900 | |
| 5 | Al | 2.0 | Ar-10% $NH_3$ | AlN | 15 | 28,600 | |
| 6 | Al | 4.0 | 100% $N_2$ | AlN | 25 | 28,500 | |
| 7 | Zr | 3.0 | 100% $N_2$ | ZrN | 12 | 27,800 | |
| 8 | Ti | 3.0 | 100% $N_2$ | TiN | 15 | 29,500 | |
| 9 | B | 3.0 | 100% $N_2$ | BN | 10 | 28,400 | |
| 10 | Mg | 3.0 | 100% $N_2$ | $Mg_3N_2$ | 20 | 27,200 | |
| 11 | Nb | 3.0 | 100% $N_2$ | NbN | 15 | 28,400 | |
| 12 | Si | 3.0 | 100% $N_2$ | $Si_3N_4$ | 12 | 27,400 | |
| 13 | V | 3.0 | 100% $N_2$ | VN | 15 | 27,800 | |
| 14 | Ta | 3.0 | 100% $N_2$ | TaN | 10 | 27,200 | |
| 15 | none | — | 100% $N_2$ | $Cr_2N$ | 15 | 27,600 | |
| 16 | Al $Fe_4N$ | 3.0 1.0 | Ar | AlN | 10 | 29,000 | |
| 17 | Al $Cr_2N$ | 3.0 0.5 | Ar | AlN | 15 | 27,300 | |
| 18 | Al $Fe_4N$ | 3.0 1.0 | 100% $N_2$ | AlN | 15 | 28,600 | |
| 19 | Al $Cr_2N$ | 3.0 0.5 | 100% $N_2$ | AlN | 10 | 29,000 | |
| 20 | B $Fe_4N$ | 3.0 1.0 | Ar | BN | 12 | 28,400 | |
| 21 | B $Cr_2N$ | 3.0 0.5 | Ar | BN | 15 | 28,800 | |
| 22 | B $Fe_4N$ | 0 1.0 | 100% N, | BN | 12 | 27,500 | |
| 23 | B $Cr_{2N}$ | 3.0 0.5 | 100% $N_2$ | BN | 20 | 29,200 | |
| 24 | TiN (60 nm) | 0.5 | Ar | TiN | 60 | 23,000 | Comparative |
| 25 | AlN (60 nm) | 0.2 | Ar | AlN | 60 | 23,400 | |
| 26 | IN (60 nm) | 0.2 | Ar | AlN | 60 | 27,500 | |

(Note)

TABLE 16-continued

| No. | Additives or Nitride | Amount (wt %) | Mechanical Alloying Atmosphere | Dispersed Particles | Particle Diameter (nm) | Young's Modulus (kgf/mm) | Remarks |
|---|---|---|---|---|---|---|---|

Matrix Composition: No. 1: Fe—13Cr (Alloy Powder)
No. 2: Fe—13Cr—2Ti (Alloy Powder)
No. 3~26: Fe—13Cr (Elemental Powders)
Dispersion: No. 1~3, 6~15: 100% $N_2$ Mechanical Alloying
No. 4 : Ar-20% $N_2$ Mechanical Alloying
No. 5 : Ar-10% $NH_2$ Mechanical Alloying
No. 16, 17, 20, 21: $Fe_4N$, $Cr_2N$ Particles added, Mechanical Alloying in Ar
No. 18, 19, 22, 23: $Fe_4N$, $Cr_2N$ Particles added, Mechanical Alloying
No. 24~26: Dispersing Particle Addition + Mechanical Alloying in Ar
Working : No. 1~25: Extrusion (Ratio: 5, Temp.: 1150° C.)
No. 26: Extrusion (Ratio: 10, Temp.: 1150° C.)
Heat Treatment: 1300° C. × 1 hr, AC

TABLE 17

| No. | Molten Steel Composition (wt %) | Heat Treatment Atmosphere | Type of Dispersed Particles | Particle Diameter (nm) | Young's Modulus (kgf/mm$^2$) | Remarks |
|---|---|---|---|---|---|---|
| 1 | Fe—14Cr | $H_2$(20° C.) | $Cr_2O_3$ | 20 | 27,500 | Present |
| 2 | Fe—14Cr—1.0 Ti | $H_2$(−70° C.) | $TiO_2$ | 30 | 29,100 | Invention |
| 3 | Fe—14Cr—1.0 Zr | $H_2$(−70° C.) | $ZrO_2$ | 30 | 28,100 | |
| 4 | Fe—14Cr—1.0 Al | $H_2$(−70° C.) | $Al_2O_3$ | 20 | 28,800 | |
| 5 | Fe—14Cr—1.0 Y | $H_2$(−70° C.) | $Y_2O_3$ | 20 | 28,300 | |
| 6 | Fe—14Cr—0.5 Ti—0.5 Y | $H_2$(−70° C.) | $Ti_xY_yO$ | 15 | 28,100 | |
| 7 | Fe—14Cr—1.0 Al | $CO/CO_2$ | $Al_2O_3$ | 15 | 29,000 | |
| 8 | Fe—14Cr | Ar | — | — | 22,000 | Comparative |

TABLE 18

| No. | Molten Steel Composition (wt %) | Heat Treatment Atmosphere | Type of Dispersed Nitride Particles | Particle Diameter (nm) | Young's Modulus (kgf/mm$^2$) | Remarks |
|---|---|---|---|---|---|---|
| 1 | Fe—14Cr | $NH_3$ | CrN | 15 | 27,300 | Present |
| 2 | Fe—14Cr—1.0 Ti | $NH_3$ | TiN | 30 | 28,700 | Invention |
| 3 | Fe—14Cr—1.0 Nb | $NH_3$ | $Nb_2N$ | 25 | 27,600 | |
| 4 | Fe—14Cr—1.0 Al | $NH_3$ | AlN | 25 | 28,500 | |
| 5 | Fe—14Cr—1.0 Y | $NH_3$ | YN | 20 | 27,900 | |
| 6 | Fe—14Cr—0.5 Ti—0.5 Y | $NH_3$ | $Ti_xY_yN$ | 20 | 27,800 | |
| 7 | Fe—14Cr—1.0 Al | $N_2$ + 50 vol % $H_2$ | AlN | 15 | 28,800 | |
| 8 | Fe—14Cr—1.0 Al | $NH_3$ + 50% Ar | AlN | 20 | 29,000 | |
| 9 | Fe—14Cr | Ar | — | — | 22,200 | Comparative |

TABLE 19

| No. | Molten Steel Composition (wt %) | Heat Treatment Atmosphere (CP) | Type of Dispersed Carbide Particles | Particle Diameter (nm) | Young's Modulus (kgf/mm$^2$) | Remarks |
|---|---|---|---|---|---|---|
| 1 | Fe—14Cr | RX gas (0.4) | $Cr_3C_2$ | 15 | 27,900 | Present |
| 2 | Fe—14Cr—1.0 Ti | RX gas (0.4) | TiC | 20 | 28,800 | Invention |
| 3 | Fe—14Cr—1.0 Nb | RX gas (0.4) | NbC | 25 | 28.500 | |
| 4 | Fe—14Cr—1.0 Zr | RX gas (0.4) | ZrC | 25 | 28,400 | |
| 5 | Fe—14Cr—1.0 V | RX gas (0.4) | VC | 20 | 25,000 | |
| 6 | Fe—14Cr—0.5 Ti—0.5 V | RX gas (0.4) | $Ti_xV_yC$ | 20 | 27,800 | |
| 7 | Fe—14Cr—1.0 Ti | RX gas (0.2) | TiC | 15 | 28,700 | |
| 8 | Fe—14Cr—1.0 Ti | RX gas (0.5) | TiC | 25 | 27,500 | |
| 9 | Fe—14Cr—1.0 Ti | Ar + $CH_4$ | TiC | 30 | 27,500 | |
| 10 | Fe—14Cr—1.0 Ti | Ar + $CH_3OH$ | TiC | 25 | 28,300 | |
| 11 | Fe—14Cr | Ar | — | — | 21,900 | Comparative |

TABLE 20

| No. | Ferrite Matrix Composition (wt %) | Dispersed Particles (Amount, Size) | Surface Hardening (Conditions) | {111} Intensity | Young's Modulus (kgf/mm$^2$) | Surface Harndess (mHv) | Hardened Thickness (μM) | Remarks |
|---|---|---|---|---|---|---|---|---|
| 1 | Fe—13Cr | 0.2 vol % $Y_2O_3$ (0.01 μm) | Gas Nitriding (100% $NH_3$, 530° C. × 60 hr – FC) | 100 | 28,200 | 1330 | 210 | Present Invention |
| 2 | Fe—13Cr | 0.2 vol % $Al_2O_3$ (0.02 μm) | Gas Nitriding (100% $NH_3$, 530° C. × 100 hr – FC) | >100 | 29,300 | 1320 | 350 | |
| 3 | Fe—30Cr | 0.2 vol % AlN (0.02 μm) | Gas Nitriding (100% $NH_3$, 520° C. × 40 hr – FC) | 80 | 27,400 | 1250 | 120 | |
| 4 | Fe—3Al | 0.2 vol % $Y_2O_3$ (0.01 μm) | Gas Nitriding (100% $NH_3$, 590° C. × 120 hr – FC) | 90 | 28,600 | 1410 | 550 | |
| 5 | Fe—3Al—3Ni | 0.2 vol % TiN (0.03 μm) | Gas Nitriding (100% $NH_3$, 550° C. × 70 hr – FC) | 100 | 29,300 | 1380 | 320 | |
| 6 | Fe—3Si—1Al | 0.2 vol % $Y_2O_3$ (0.01 μm) | Gas Nitriding (100% $NH_3$, 560° C. × 80 hr – FC) | 80 | 27,900 | 1430 | 460 | |
| 7 | Fe—3Cr—2Al | 0.2 vol % $Y_2O_3$ (0.01 μm) | Gas Nitriding (100% $NH_3$, 540° C. × 60 hr – FC) | 90 | 28,700 | 1030 | 280 | |
| 8 | Fe—13Cr | 0.2 vol % $Y_2O_3$ (0.01 μm) | Ion Nitriding ($H_2$-25% $N_2$ · 5 torr, 580° C. × 60 hr – FC) | 90 | 28,200 | 1260 | 520 | |
| 9 | Fe—13Cr | 0.2 vol % $Al_2O_3$ (0.02 μm) | Ion Nitriding ($H_2$-25% $N_2$ · 5 torr, 620° C. × 80 hr – FC) | 100 | 29,300 | 1430 | 640 | |
| 10 | Fe—30Cr | 0.2 vol % AlN (0.02 μm) | Ion Nitriding ($H_2$-25% $N_2$ · 5 torr, 550° C. × 15 hr – FC) | 70 | 27,400 | 1250 | 180 | |
| 11 | Fe—3Al | 0.2 vol % $Y_2O_3$ (0.01 μm) | Ion Nitriding ($H_2$-50% $N_2$ · 3 torr, 580° C. × 80 hr – FC) | 90 | 28,600 | 1380 | 550 | |
| 12 | Fe—3Al—3Ni | 0.2 vol % TiN (0.03 μm) | Ion Nitriding ($H_2$-50% $N_2$ · 3 torr, 580° C. × 50 hr – FC) | 90 | 29,300 | 1290 | 420 | |
| 13 | Fe—3Si—1Al | 0.2 vol % $Y_2O_3$ (0.01 μm) | Ion Nitriding ($H_2$-80% $N_2$ · 2 torr, 580° C. × 60 hr – FC) | 80 | 27,900 | 1340 | 470 | |
| 14 | Fe—3Cr—2Al | 0.2 vol % $Y_2O_3$ (0.01 μm) | Ion Nitriding ($H_2$-25% $N_2$ · 5 torr, 480° C. × 25 hr – FC) | 80 | 28,700 | 960 | 240 | |

Dispersion: Mechanical Alloying with addition of particles
Extrusion: 1050° C., Ratio: 10, Heat Treatment: 1300° C. × 1 Hr · AC

TABLE 21

| No. | Ferrite Matrix Composition (wt %) | Dispersed Particles (Amount, Size) | Surface Hardening (Conditions) | {111} Intensity | Young's Modulus (kgf/mm$^2$) | Surface Harndess (mHv) | Hardened Thickness (μM) | Remarks |
|---|---|---|---|---|---|---|---|---|
| 15 | Fe—13Cr | 0.2 vol % $Y_2O_3$ (0.01 μm) | Gas Soft Nitriding ($NH_3$: RX* = 1:1, 570° C. × 8 hr – FC) | 100 | 28,200 | 750 | 890 | Present Invention |
| 16 | Fe—13Cr | 0.2 vol % $Al_2O_3$ (0.02 μm) | Gas Soft Nitriding ($NH_3$: RX* = 1:1, 570° C. × 8 hr – FC) | >100 | 29,300 | 760 | 900 | |
| 17 | Fe—30Cr | 0.2 vol % AlN (0.02 μm) | Gas Soft Nitriding ($NH_3$: RX* = 1:1, 580° C. × 8 hr – FC) | 70 | 27,400 | 680 | 1030 | |
| 18 | Fe—3Al | 0.2 vol % $Y_2O_3$ (0.01 μm) | Gas Soft Nitriding ($NH_3$: RX* = 1:1, 560° C. × 8 hr – FC) | 80 | 28,600 | 780 | 960 | |
| 19 | Fe—3Al—3Ni | 0.2 vol % TiN (0.03 μm) | Gas Soft Nitriding ($NH_3$: RX* = 1:1, 570° C. × 10 hr – FC) | 90 | 29,300 | 750 | 1250 | |
| 20 | Fe—3Si—1Al | 0.2 vol % $Y_2O_3$ (0.01 μm) | Gas Soft Nitriding ($NH_3$: RX* = 1:1, 640° C. × 8 hr – FC) | 70 | 27,900 | 650 | 820 | |
| 21 | Fe—3Cr—2Al | 0.2 vol % $Y_2O_3$ (0.01 μm) | Gas Soft Nitriding ($NH_3$: RX* = 1:1, 540° C. × 6 hr – FC) | 90 | 28,700 | 600 | 790 | |
| 22 | Fe—13Cr | 0.2 vol % $Y_2O_3$ (0.01 μm) | Gas Carburization ($CH_4$: RX* = 1:3, 970° C. × 6 hr – OQ-tempering**) | 80 | 28,200 | 850 | 940 | |
| 23 | Fe—13Cr | 0.2 vol % $Al_2O_3$ | Gas Carburization ($CH_4$: RX* = 1:3, 920° C. × | >100 | 29,300 | 930 | 1080 | |

TABLE 21-continued

| No. | Ferrite Matrix Composition (wt %) | Dispersed Particles (Amount, Size) | Surface Hardening (Conditions) | {111} Intensity | Young's Modulus (kgf/mm$^2$) | Surface Harndess (mHv) | Hardened Thickness (μM) | Remarks |
|---|---|---|---|---|---|---|---|---|
| | | (0.02 μm) | 9 hr – OQ-tempering**) | | | | | |
| 24 | Fe—1.5Al | 0.2 vol % $Y_2O_3$ (0.01 μm) | Gas Carburization ($CH_4$: RX* = 1:3, 910° C. × 12 hr – OQ-tempering**) | 70 | 27,900 | 790 | 1290 | |
| 25 | Fe—3Al-3Ni | 0.2 vol % TiN (0.03 μm) | Gas Carburization ($CH_4$: RX* = 1:3, 880° C. × 9 hr – OQ-tempering**) | 100 | 29,300 | 840 | 980 | |
| 26 | Fe—3Cr—1Al | 0.2 vol % $Y_2O_3$ (0.01 μm) | Gas Carburization ($CH_4$: RX* = 1:3, 900° C. × 6 hr – OQ-tempering**) | 70 | 27,200 | 870 | 920 | |
| 27 | Fe—20Cr—3Al | 0.2 vol % $Y_2O_3$ (0.01 μm) | Gas Carburization ($CH_4$: RX* = 1:3, 900° C. × 6 hr – OQ-tempering**) | 70 | 27,400 | 240 | 0 | Comparative |

Dispersion: Mechanical Alloying with addition of particles
Extrusion: 1050° C., Ratio: 10, heat Treatment: 1300° C. × 1 Hr · AC
*RX: 40% $N_2$ - 30% $H_2$- bal. CO,
**Tempering: 250° C. × 1 Hr – AC

TABLE 22

| No. | Ferrite Matrix Composition (wt %) | Dispersed Particles (Amount, Size) | Surface Hardening (Conditions) | Young's Modulus (kgf/mm$^2$) | Surface Hardness (mHv) | Hardened Thickness (μM) | Remarks |
|---|---|---|---|---|---|---|---|
| 28 | Fe—13Cr | 0.2 vol % $Y_2O_3$ (0.01 μm) | Tufftriding (Salt-Bath Nitriding) (KCN + KCNO Salt-Bath, 570° C. × 3 hr – WQ) | 28,400 | 1240 | 40 | Present Invention |
| 29 | Fe—13Cr | 0.2 vol % $Al_2O_3$ (0.02 μm) | Tufftriding (Salt-Bath Nitriding) (KCN + KCNO Salt-Bath, 570° C. × 3 hr – OQ) | 28,800 | 1100 | 50 | |
| 30 | Fe—30Cr | 0.2 vol % AlN (0.02 μm) | Tufftriding (Salt-Bath Nitriding) (KCN + KCNO Salt-Bath, 500° C. × 1 hr – WQ) | 28,100 | 1050 | 200 | |
| 31 | Fe—3Al | 0.2 vol % $Y_2O_3$ (0.01 μm) | Tufftriding (Salt-Bath Nitriding) (KCN + KCNO Salt-Bath, 600° C. × 1 hr – WQ) | 27,900 | 1300 | 10 | |
| 32 | Fe—3Al—3Ni | 0.2 vol % TiN (0.03 μm) | Tufftriding (Salt-Bath Nitriding) (KCN + KCNO Salt-Bath, 570° C. × 3 hr – WQ) | 27,000 | 1210 | 80 | |
| 33 | Fe—3Si—1Al | 0.2 vol % $Y_2O_3$ (0.01 μm) | Tufftriding (Salt-Bath Nitriding) (KCN + KCNO Salt-Bath, 570° C. × 3 hr – WQ) | 29,200 | 1270 | 40 | |
| 34 | Fe—3Cr—2Al | 0.2 vol % $Y_2O_3$ (0.01 μm) | Tufftriding (Salt-Bath Nitriding) (KCN + KCNO Salt-Bath, 570° C. × 3 hr – WQ) | 28,700 | 1170 | 30 | |

Dispersion: Mechanical Alloying with addition of particles
Extrusion: 1050° C., Ratio: 10, Heat Treatment: 1300° C. × 1 Hr · AC
WQ: Water Quenching, OQ: Oil Quenching

TABLE 23

| | Matrix | Dispersed Particle | | | | |
|---|---|---|---|---|---|---|
| No. | Composition (wt %) | Type | Size (μm) | Amount (vol %) | Dispersing Method | Working Conditions |
| 1 | Fe—13Cr | — | — | 0 | Ingot Making | Rolling(1000° C., Rolling Ratio 5) |
| 2 | " | $Y_2O_3$ | 0.02 | 0.5 | MA *1 | HIP(1000° C. × 1 hr, 2000 atm) Rolling(1000° C., Rolling Ratio 5) |
| 3 | " | " | " | 1.0 | " | HIP(1000° C. × 1 hr, 2000 atm) Rolling(1000° C., Rolling Ratio 5) |
| 4 | " | " | " | 3.0 | " | HIP(1000° C. × 1 hr, 2000 atm) Rolling(1000° C., Rolling Ratio 5) |
| 5 | " | $Al_2O_3$ | " | 0.5 | " | HIP(1000° C. × 1 hr, 2000 atm) Rolling(1000° C., Rolling Ratio 5) |
| 6 | " | " | 0.06 | " | " | HIP(1000° C. × 1 hr, 2000 atm) Rolling(1000° C., Rolling Ratio 5) |
| 7 | " | " | 0.10 | " | " | HIP(1000° C. × 1 hr, 2000 atm) Rolling(1000° C., Rolling Ratio 5) |
| 8 | " | TiC | 0.02 | " | " | HIP(1000° C. × 1 hr, 2000 atm) Rolling(1000° C., Rolling Ratio 5) |
| 9 | " | AlN | " | " | " | HIP(1000° C. × 1 hr, 2000 atm) Rolling(1000° C., Rolling Ratio 5) |

TABLE 23-continued

| | | | | | | |
|---|---|---|---|---|---|---|
| 10 | " | $TiB_2$ | " | " | " | HIP(1000° C. × 1 hr, 2000 atm) Rolling(1000° C., Rolling Ratio 5) |
| 11 | " | BN | " | " | " | HIP(1000° C. × 1 hr, 2000 atm) Rolling(1000° C., Rolling Ratio 5) |
| 12 | " | $Al_2O_3$ | " | " | " | HIP(1000° C. × 1 hr, 2000 atm) Rolling(1000° C., Rolling Ratio 2) |
| 13 | " | " | " | " | " | HIP(1000° C. × 1 hr, 2000 atm) Rolling(1000° C., Rolling Ratio 1.5) |
| 14 | " | " | " | " | " | HIP(1000° C. × 1 hr, 2000 atm) Rolling(900° C., Rolling Ratio 5) |
| 15 | " | " | " | " | " | HIP(1000° C. × 1 hr, 2000 atm) Rolling(1200° C., Rolling Ratio 5) |
| 16 | " | " | " | " | " | HIP(1000° C. × 1 hr, 2000 atm) Rolling(Room Temp., Rolling Ratio 2) |
| 17 | " | " | " | " | " | CIP(Room Temp., 1000 atm) Rolling(1000° C., Rolling Ratio 5) |
| 18 | " | " | " | " | " | Packed in Capsule Rolling(1000° C., Rolling Ratio 5) |
| 19 | " | " | " | " | " | HIP(1000° C. × 1 hr, 2000 atm) Rolling(1000° C., Rolling Ratio 5) |
| 20 | " | " | " | " | " | HIP(1000° C. × 1 hr, 2000 atm) Rolling(1000° C., Rolling Ratio 5) |
| 21 | " | " | " | " | " | HIP(1000° C. × 1 hr, 2000 atm) Rolling(1000° C., Rolling Ratio 5) |

| No. | Heat Treatment | {111} Intensity | $I_{222}/I_{110}$ | Young's Modulus (kgf/mm$^2$) | T.S. (kgf/mm$^2$) | Remarks |
|---|---|---|---|---|---|---|
| 1 | 1300° C. × 1 hr, AC | 0.4 | 0.01 | 18,400 | 30 | Comparative |
| 2 | 1250° C. × 1 hr, AC | 70 | 1.2 | 26,900 | 70 | Present |
| 3 | 1300° C. × 1 hr, AC | 80 | 1.8 | 27,100 | 80 | Invention |
| 4 | 1350° C. × 1 hr, AC | 90 | 2.3 | 27,300 | 85 | |
| 5 | 1250° C. × 1 hr, AC | 80 | 1.4 | 27,500 | 80 | |
| 6 | 1250° C. × 1 hr, AC | 70 | 0.6 | 26,200 | 75 | |
| 7 | 1250° C. × 1 hr, AC | 25 | 0.2 | 24,400 | 66 | |
| 8 | 1200° C. × 1 hr, AC | 70 | 1.3 | 26,800 | 80 | |
| 9 | 1250° C. × 1 hr, AC | 80 | 1.5 | 27,400 | 85 | |
| 10 | 1300° C. × 1 hr, AC | 70 | 1.4 | 27,000 | 80 | |
| 11 | 1300° C. × 1 hr, AC | 50 | 0.7 | 26,100 | 70 | |
| 12 | 1350° C. × 1 hr, AC | 40 | 0.4 | 25,100 | 66 | |
| 13 | 1350° C. × 1 hr, AC | 7 | 0.02 | 22,700 | 40 | Comparative |
| 14 | 1200° C. × 1 hr, AC | 100 | 3.4 | 28,900 | 75 | Present |
| 15 | 1300° C. × 1 hr, AC | 60 | 0.9 | 26,300 | 70 | Invention |
| 16 | 900° C. × 1 hr, AC | >100 | 3.6 | 29,400 | 66 | |
| 17 | 1200° C. × 1 hr, AC | 90 | 1.9 | 28,400 | 80 | |
| 18 | 1200° C. × 1 hr, AC | 90 | 2.1 | 28,100 | 75 | |
| 19 | None | 7 | 0.02 | 22,700 | 80 | |
| 20 | 800° C. × 1 hr, AC | 8 | 0.02 | 22,800 | 75 | Comparative |
| 21 | 1450° C. × 1 hr, AC | 2 | 0.01 | 22,300 | 50 | |

(Note)
*1: Mechanical Alloying

TABLE 24

| | Matrix | Dispersing Particle | | | | |
|---|---|---|---|---|---|---|
| No. | Composition (wt %) | Type | Size (μm) | Amount (vol %) | Dispersing Method | Working Conditions |
| 22 | Fe—4Al | $Y_2O_3$ | 0.02 | 0.5 | MA *1 | HIP(1000° C. × 1 hr, 2000 atm) Rolling(1000° C., Rolling Ratio 5) |
| 23 | " | " | " | 1.0 | " | HIP(1000° C. × 1 hr, 2000 atm) Rolling(1000° C., Rolling Ratio 5) |
| 24 | " | " | " | 3.0 | " | HIP(1000° C. × 1 hr, 2000 atm) Rolling(1000° C., Rolling Ratio 5) |
| 25 | " | $Al_2O_3$ | " | 0.5 | MA + Reactive Dispersion *2 | HIP(1000° C. × 1 hr, 2000 atm) Rolling(1000° C., Rolling Ratio 5) |
| 26 | " | " | " | " | Air *3 Atomization | HIP(1000° C. × 1 hr, 2000 atm) Rolling(1000° C., Rolling Ratio 5) |
| 27 | " | AlN | " | " | MA + Reactive Dispersion *2 | HIP(1000° C. × 1 hr, 2000 atm) Rolling(1000° C., Rolling Ratio 5) |
| 28 | " | " | " | " | Nitrogen *4 Atomization | HIP(1000° C. × 1 hr, 2000 atm) Rolling(1000° C., Rolling Ratio 5) |
| 29 | " | TiC | 0.02 | " | MA *1 | HIP(1000° C. × 1 hr, 2000 atm) Rolling(1000° C., Rolling Ratio 5) |
| 30 | " | TiN | " | " | " | HIP(1000° C. × 1 hr, 2000 atm) |

TABLE 24-continued

| | | | | | | |
|---|---|---|---|---|---|---|
| 31 | " | $TiB_2$ | " | " | " | Rolling(1000° C., Rolling Ratio 5) HIP(1000° C. × 1 hr, 2000 atm) |
| 32 | " | BN | " | " | " | Rolling(1000° C., Rolling Ratio 5) HIP(1000° C. × 1 hr, 2000 atm) |
| 33 | " | $Y_2O_3$ | " | " | " | Rolling(1000° C., Rolling Ratio 5) HIP(1000° C. × 1 hr, 2000 atm) |
| 34 | " | " | " | " | " | Rolling(1000° C., Rolling Ratio 2) HIP(1000° C. × 1 hr, 2000 atm) |
| 35 | " | " | " | " | " | Rolling(1000° C., Rolling Ratio 1.5) HIP(1000° C. × 1 hr, 2000 atm) |
| 36 | " | " | " | " | " | Rolling(900° C., Rolling Ratio 5) HIP(1000° C. × 1 hr, 2000 atm) |
| 37 | " | " | " | " | " | Rolling(1200° C., Rolling Ratio 5) HIP(1000° C. × 1 hr, 2000 atm) |
| 38 | " | " | " | " | " | Rolling(Room Temp., Rolling Ratio 2) CIP(Room Temp., 1000 atm) |
| 39 | " | " | " | " | " | Rolling(1000° C., Rolling Ratio 5) Packed in Capsule Rolling(1000° C., Rolling Ratio 5) |

| No. | Heat Treatment | {111} Intensity | $I_{222}/I_{110}$ | Young's Modulus (kgf/mm$^2$) | T.S. (kgf/mm$^2$) | Remarks |
|---|---|---|---|---|---|---|
| 22 | 1250° C. × 1 hr, AC | 70 | 1.3 | 27,100 | 75 | Present |
| 23 | 1300° C. × 1 hr, AC | 80 | 1.9 | 27,400 | 80 | Invention |
| 24 | 1350° C. × 1 hr, AC | 70 | 1.1 | 26,700 | 80 | |
| 25 | 1200° C. × 1 hr, AC | 80 | 1.3 | 27,400 | 75 | |
| 26 | 1200° C. × 1 hr, AC | 70 | 1.1 | 27,000 | 70 | |
| 27 | 1200° C. × 1 hr, AC | 60 | 0.9 | 26,900 | 66 | |
| 28 | 1200° C. × 1 hr, AC | 70 | 1.0 | 26,700 | 70 | |
| 29 | 1200° C. × 1 hr, AC | 60 | 0.8 | 26,400 | 80 | |
| 30 | 1200° C. × 1 hr, AC | 80 | 1.5 | 27,600 | 66 | |
| 31 | 1300° C. × 1 hr, AC | 60 | 1.2 | 26,500 | 70 | |
| 32 | 1250° C. × 1 hr, AC | 70 | 1.3 | 27,100 | 80 | |
| 33 | 1350° C. × 1 hr, AC | 30 | 0.3 | 24,900 | 70 | |
| 34 | 1350° C. × 1 hr, AC | 4 | 0.02 | 22,000 | 40 | Comparative |
| 35 | 1250° C. × 1 hr, AC | 100 | 3.2 | 28,100 | 85 | Present |
| 36 | 1300° C. × 1 hr, AC | 60 | 0.8 | 26,500 | 80 | Invention |
| 37 | 1150° C. × 1 hr, AC | >100 | 3.3 | 29,200 | 70 | |
| 38 | 1250° C. × 1 hr, AC | 80 | 1.6 | 27,800 | 75 | |
| 39 | 1250° C. × 1 hr, AC | 80 | 1.3 | 26,100 | 80 | |

(Note)
*1: Mechanical Alloying
*2: Mechanical Alloying in a reactive atmosphere (No. 25: Ar-0.01% $O_2$ + MA, No. 27: 100% $N_2$ + MA)
*3: Air Atomization followed by rapid solidification to precipitate fine partiles.
*4: Nitrogen Atomization

TABLE 25

| | Matrix | Dispersed Particle | | | | |
|---|---|---|---|---|---|---|
| No. | Composition (wt %) | Type | Size (μm) | Amount (vol %) | Dispersing Method | Working Conditions |
| 40 | Fe—13Si | $Y_2O_3$ | 0.02 | 0.5 | MA *1 | HIP(1000° C. × 1 hr, 2000 atm) Rolling(1000° C., Rolling Ratio 5) |
| 41 | " | $Al_2O_3$ | " | " | " | HIP(1000° C. × 1 hr, 2000 atm) Rolling(1000° C., Rolling Ratio 5) |
| 42 | " | AlN | " | " | " | HIP(1000° C. × 1 hr, 2000 atm) Rolling(1000° C., Rolling Ratio 5) |
| 43 | " | TiC | " | " | " | HIP(1000° C. × 1 hr, 2000 atm) Rolling(1000° C., Rolling Ratio 5) |
| 44 | " | TiN | " | " | " | HIP(1000° C. × 1 hr, 2000 atm) Rolling(1000° C., Rolling Ratio 5) |
| 45 | " | $TiB_2$ | " | " | " | HIP(1000° C. × 1 hr, 2000 atm) Rolling(1000° C., Rolling Ratio 5) |
| 46 | " | BN | " | " | " | HIP(1000° C. × 1 hr, 2000 atm) Rolling(1000° C., Rolling Ratio 5) |
| 47 | Fe—22Cr | $Y_2O_3$ | " | " | " | HIP(1000° C. × 1 hr, 2000 atm) Rolling(1000° C., Rolling Ratio 5) |
| 48 | " | $Al_2O_3$ | " | " | " | HIP(1000° C. × 1 hr, 2000 atm) Rolling(1000° C., Rolling Ratio 5) |
| 49 | " | AlN | " | " | " | HIP(1000° C. × 1 hr, 2000 atm) Rolling(1000° C., Rolling Ratio 5) |
| 50 | " | TiC | " | " | " | HIP(1000° C. × 1 hr, 2000 atm) |

TABLE 25-continued

| | | | | | | |
|---|---|---|---|---|---|---|
| | | | | | | Rolling(1000° C., Rolling Ratio 5) |
| 51 | " | TiN | " | " | " | HIP(1000° C. × 1 hr, 2000 atm) |
| | | | | | | Rolling(1000° C., Rolling Ratio 5) |
| 52 | " | $TiB_2$ | " | " | " | HIP(1000° C. × 1 hr, 2000 atm) |
| | | | | | | Rolling(1000° C., Rolling Ratio 5) |
| 53 | " | BN | " | " | " | HIP(1000° C. × 1 hr, 2000 atm) |
| | | | | | | Rolling(1000° C., Rolling Ratio 5) |
| 54 | Fe—6Cr—3Al—1.0Mo | $Y_2O_3$ | " | " | " | HIP(1000° C. × 1 hr, 2000 atm) |
| | | | | | | Rolling(1000° C., Rolling Ratio 5) |
| 55 | Fe—6Cr—3Al—1.0Mo | TiC | " | " | " | HIP(1000° C. × 1 hr, 2000 atm) |
| | | | | | | Rolling(1000° C., Rolling Ratio 5) |
| 56 | Fe—6Cr—3Al—1.0Mo | TiN | " | " | " | HIP(1000° C. × 1 hr, 2000 atm) |
| | | | | | | Rolling(1000° C., Rolling Ratio 5) |
| 57 | Fe—6Cr—3Al—1.0Mo | $TiB_2$ | " | " | " | HIP(1000° C. × 1 hr, 2000 atm) |
| | | | | | | Rolling(1000° C., Rolling Ratio 5) |
| 58 | Fe—6Cr—3Al—1.0Mo | BN | " | " | " | HIP(1000° C. × 1 hr, 2000 atm) |
| | | | | | | Rolling(1000° C., Rolling Ratio 5) |

| No. | Heat Treatment | {111} Intensity | $I_{222}/I_{110}$ | Young's Modulus (kgf/mm$^2$) | T.S. (kgf/mm$^2$) | Remarks |
|---|---|---|---|---|---|---|
| 40 | 1250° C. × 1 hr, AC | 70 | 1.5 | 27,100 | 70 | Present |
| 41 | 1200° C. × 1 hr, AC | 80 | 1.6 | 27,400 | 85 | Invention |
| 42 | 1200° C. × 1 hr, AC | 60 | 1.1 | 26,900 | 80 | |
| 43 | 1250° C. × 1 hr, AC | 60 | 0.7 | 26,400 | 70 | |
| 44 | 1200° C. × 1 hr, AC | 80 | 1.8 | 27,600 | 75 | |
| 45 | 1300° C. × 1 hr, AC | 60 | 0.9 | 26,500 | 70 | |
| 46 | 1250° C. × 1 hr, AC | 70 | 1.2 | 27,100 | 70 | |
| 47 | 1300° C. × 1 hr, AC | 60 | 1.0 | 26,500 | 66 | |
| 48 | 1200° C. × 1 hr, AC | 70 | 1.0 | 27,000 | 80 | |
| 49 | 1200° C. × 1 hr, AC | 70 | 1.5 | 27,300 | 80 | |
| 50 | 1200° C. × 1 hr, AC | 70 | 1.2 | 27,800 | 85 | |
| 51 | 1250° C. × 1 hr, AC | 70 | 1.4 | 26,300 | 75 | |
| 52 | 1300° C. × 1 hr, AC | 60 | 0.8 | 26,100 | 66 | |
| 53 | 1200° C. × 1 hr, AC | 60 | 0.9 | 26,300 | 75 | |
| 54 | 1250° C. × 1 hr, AC | 70 | 1.5 | 27,500 | 70 | |
| 55 | 1200° C. × 1 hr, AC | 70 | 1.3 | 27,200 | 80 | |
| 56 | 1200° C. × 1 hr, AC | 80 | 1.6 | 27,500 | 85 | |
| 57 | 1250° C. × 1 hr, AC | 80 | 1.4 | 27,300 | 80 | |
| 58 | 1250° C. × 1 hr, AC | 90 | 1.6 | 27,700 | 80 | |

(Note) *1: Mechanical Alloying

TABLE 26

| No. | Molten Steel Composition (wt %) | Atmosphere when Melted | Atomizing Gas | Type of Dispersed Particles | Particle Diameter (nm) | Young's Modulus (kgf/mm$^2$) | Remarks |
|---|---|---|---|---|---|---|---|
| 1 | Fe—14Cr | $N_2$ | $N_2$ | CrN | 20 | 27,500 | Present |
| 2 | Fe—14Cr—1.0 Ti | $N_2$ | $N_2$ | TiN | 30 | 29,100 | Invention |
| 3 | Fe—14Cr—1.0 Nb | $N_2$ | $N_2$ | NbN | 30 | 28,100 | |
| 4 | Fe—14Cr—1.0 Al | $N_2$ | $N_2$ | AlN | 20 | 28,800 | |
| 5 | Fe—14Cr—1.0 Y | $N_2$ | $N_2$ | YN | 20 | 28,300 | |
| 6 | Fe—14Cr—0.5 Ti—0.5 Y | $N_2$ | $N_2$ | $Ti_xY_yN$ | 15 | 28,100 | |
| 7 | Fe—14Cr—1.0 Al | $N_2$ | $NH_3$ | AlN | 15 | 29,000 | |
| 8 | Fe—14Cr—1.0 Al | $N_2$ | $N_3 + H_2$ | AlN | 15 | 28,800 | |
| 9 | Fe—14Cr—1.0 Al | $N_2$ | $N_2$ + Ar | AlN | 20 | 27,900 | |
| 10 | Fe—14Cr—1.0 Al | $N_2$ | $NH_3$ + Ar | AlN | 20 | 28,200 | |
| 11 | Fe—14Cr—1.0 Al | $N_2$ | Liq. $N_2$ | AlN | 15 | 28,500 | |
| 12 | Fe—14Cr—1.0 Al | $N_2$ | Ar | AlN | 25 | 28,200 | |
| 13 | Fe—14Cr—1.0 Al | Ar | $N_2$ | AlN | 20 | 28,200 | |
| 14 | Fe—14Cr—1.0 Al + $Cr_2N$ | Ar | Ar | AlN | 25 | 27,500 | |
| 15 | Fe—14Cr | Ar | Ar | — | — | 22,000 | Comparative |

TABLE 27

| No. | Molten Steel Composition (wt %) | Atmosphere when Melted | Atomizing Gas | Type of Dispersed Particles | Particle Diameter (nm) | Young's Modulus (kgf/mm$^2$) | Remarks |
|---|---|---|---|---|---|---|---|
| 1 | Fe—14Cr | Ar | Air | $Cr_2O_3$ | 20 | 27,500 | Present |
| 2 | Fe—14Cr—1.0 Ti | Ar | Air | $TiO_2$ | 30 | 29,100 | Invention |
| 3 | Fe—14Cr—1.0 Zr | Ar | Air | $ZrO_2$ | 30 | 28,100 | |
| 4 | Fe—14Cr—1.0 Al | Ar | Air | $Al_2O_3$ | 20 | 28,800 | |
| 5 | Fe—14Cr—1.0 Y | Ar | Air | $Y_2O_3$ | 20 | 28,900 | |
| 6 | Fe—14Cr—0.5 Ti—0.5 Y | Ar | Air | $Ti_xY_yN$ | 15 | 28,100 | |
| 7 | Fe—14Cr—1.0 Al | Ar | Water | $Al_2O_3$ | 15 | 29,000 | |
| 8 | Fe—14Cr—1.0 Al | Ar | Ar + $O_2$ | $Al_2O_3$ | 15 | 28,800 | |
| 9 | Fe—14Cr—1.0 Al | Ar + $H_2O$ | Ar | $Al_2O_3$ | 20 | 27,900 | |
| 10 | Fe—14Cr—1.0 Al | Ar + $H_2O$ | Air | $Al_2O_3$ | 20 | 28,200 | |
| 11 | Fe—14Cr—1.0 Al | Ar + $H_2O$ | $N_2$ | AlN, $Al_2O_3$ | 15 | 28,500 | |
| 12 | Fe—14Cr—1.0 Al + FeO | Ar + $H_2O$ | Ar | $Al_2O_3$ | 25 | 28,200 | |
| 13 | Fe—14Cr—1.0 Al + FeO | Ar | Air | $Al_2O_3$ | 20 | 28,200 | |
| 14 | Fe—14Cr—1.0 Al + FeO | Ar | Ar | $Al_2O_3$ | 25 | 27,500 | |
| 15 | Fe—14Cr | Ar | Ar | — | — | 22,000 | Comparative |

What is claimed is:

1. A high-rigidity composite material having particles dispersed in a matrix of a ferritic steel, with the degree of accumulation of {111} planes in a plane perpendicular to a given direction, in terms of X-ray diffraction intensity, being 30 times larger than that of equiaxial polycrystals.

2. A high-rigidity composite material as set forth in claim 1 wherein the ferritic steel comprises not more than 16% by weight of Cr and 0–3% by weight of Al.

3. A high-rigidity composite material as set forth in claim 1 wherein the ferritic steel comprises more than 3% by weight but not more than 8% by weight of Al.

4. A high-rigidity composite material as set forth in claim 3 wherein the ferritic steel further comprises not more than 16% by weight of Cr.

5. A high-rigidity composite material as set forth in claim 1 wherein the ferritic steel comprises more than 16% by weight but not more than 30% by weight of Cr and 0–4% by weight of Al.

6. A high-rigidity composite material as set forth in claim 1 wherein the ferritic steel comprises not more than 4% by weight of Si.

7. A high-rigidity composite material as set forth in claim 1 wherein the composite material further comprises a surface hardening layer derived by carburizing, nitriding, or soft-nitriding in the surface thereof.

8. A high-rigidity composite material having particles dispersed in a matrix of a ferritic steel structure, with the ratio of {222} planes to {110} planes in a plane perpendicular to a given direction, in terms of X-ray diffraction intensity, being 0.10 or larger.

9. A high-rigidity composite material as set forth in claim 8 wherein the ferritic steel comprises not more than 16% by weight of Cr and 0–3% by weight of Al.

10. A high-rigidity composite material as set forth in claim 8 wherein the ferritic steel comprises more than 3% by weight but not more than 8% by weight of Al.

11. A high-rigidity composite material as set forth in claim 10 wherein the ferritic steel further comprises not more than 16% by weight of Cr.

12. A high-rigidity composite material as set forth in claim 8 wherein the ferritic steel comprises more than 16% by weight but not more than 30% by weight of Cr and 0–4% by weight of Al.

13. A high-rigidity composite material as set forth in claim 8 wherein the ferritic steel comprises not more than 4% by weight of Si.

14. A high-rigidity composite material as set forth in claim 8 wherein the composite material further comprises a surface hardening layer derived by carburizing, nitriding, or soft-nitriding in the surface thereof.

* * * * *